US006784863B2

(12) United States Patent
Yanagi et al.

(10) Patent No.: US 6,784,863 B2
(45) Date of Patent: Aug. 31, 2004

(54) ACTIVE MATRIX LIQUID CRYSTAL DISPLAY AND METHOD OF DRIVING THE SAME

(75) Inventors: Toshihiro Yanagi, Taki-gun (JP); Kouji Kumada, Tenri (JP); Takashige Ohta, Yamatokoriyama (JP); Katsuya Mizukata, Shijonawate (JP)

(73) Assignee: Sharp Kabushiki Kaisha, Osaka (JP)

( * ) Notice: Subject to any disclaimer, the term of this patent is extended or adjusted under 35 U.S.C. 154(b) by 166 days.

(21) Appl. No.: 09/977,912

(22) Filed: Oct. 4, 2001

(65) Prior Publication Data

US 2002/0063669 A1 May 30, 2002

(30) Foreign Application Priority Data

Oct. 6, 2000 (JP) ..... 2000-308392
Jul. 26, 2001 (JP) ..... 2001-226740

(51) Int. Cl.[7] ..... G09G 3/36
(52) U.S. Cl. ..... 345/96; 345/94
(58) Field of Search ..... 345/87–102; G09G 3/36

(56) References Cited

U.S. PATENT DOCUMENTS 5,648,793 A * 7/1997 Chen ..... 345/96
5,694,145 A 12/1997 Kondo et al. ..... 345/90
5,892,494 A 4/1999 Kimura et al. ..... 345/96
5,894,297 A * 4/1999 Mizutome et al. ..... 345/99

FOREIGN PATENT DOCUMENTS

JP 03-245119 * 10/1991 ..... G09G/3/36
JP 5-2208 1/1993
JP 06-337657 * 12/1994 ..... G09G/3/36
JP 10062748 3/1998
JP 2000-111878 4/2000
JP 2000-267618 * 9/2000 ..... G09G/3/20

OTHER PUBLICATIONS

Euro pean Search Report on European Patent Application No. EP 01123775.7 mailed Feb. 27, 2004.
H. Hori, "Key Issu es Regarding High–Information–Content TFT–LCDs for Data Graphics", proceedings of the SID, Society for Information Display, Del Rey, CA, US, vol. 32, No. 4, 1991, pp. 331–337.
U.S. patent application Ser. No. 09/856,926, Tsuda et al., May 2001.
Chinese Patent Office First Office Action dated Aug. 1, 2003 (4 pp.) for application No. 01135445.3 and English Translation (6 pp.).

* cited by examiner

*Primary Examiner*—Alexander Eisen
(74) *Attorney, Agent, or Firm*—David G. Conlin; George W. Hartnell, III; Edwards & Angell, LLP

(57) ABSTRACT

An active matrix liquid crystal display drives liquid crystal by writing through TFTs, etc. a source signal from a signal line drive circuit to display electrodes in display cells on a matrix substrate and applying a common signal supplied from a common signal generator to common electrodes on an opposite substrate, the common signal changing in polarity in each frame. After scanning is completed for scan lines corresponding to one frame, a controller controls the interval between scan periods and the cycle of change in polarity of the common signal so as to provide a non-scan period that is longer than the scan period. The provision of the non-scan period extends the duration in which a specified voltage is retained by the display cell. This reduces the effects of variations in retained voltages caused by parasitic capacitance which develops in reflective electrode structures in which the display electrodes partly overlook scan lines and signal lines. Thus, in frame inversion drive, differences in brightness between the top and bottom of the display screen are reduced, and display quality is improved.

20 Claims, 18 Drawing Sheets

ACTIVE MATRIX LIQUID CRYSTAL DISPLAY AND METHOD OF DRIVING THE SAME

FIELD OF THE INVENTION

The present invention relates to an active matrix liquid crystal display and a method of driving the display, suitable for use in various data terminals and television sets, and in particular, relates to an active matrix liquid crystal display and a method of driving the display which allow for improvement of display quality and reduction of power consumption.

BACKGROUND OF THE INVENTION

The liquid crystal display of active matrix drive mode is an example of conventionally known image displays. As shown in FIG. 16, the liquid crystal display is composed of a liquid crystal panel 1, a scan line drive circuit 2, and a signal line drive circuit 3.

The liquid crystal panel 1 includes a matrix substrate 7, an opposite substrate 8, and liquid crystal (not shown) injected between the substrates 7, 8. The opposite substrate 8 is disposed parallel to the matrix substrate 7. On the matrix substrate 7 are there provided signal lines S(1) to S(I) and scan lines G(1) to G(J) that cross each other, as well as display cells P arranged in a matrix. On the opposite substrate 8, an opposite electrode 13 shown in FIG. 17 is provided commonly to all the display cells P.

As shown in FIG. 17, each display cell P has a thin film transistor (TFT) 11, which is a switching element, and a liquid crystal capacitance $C_{LC}$. As shown also in FIG. 18, the TFT 11 is connected at its source to the signal line S(i) and at its gate to the scan line G(j). The signal line drive circuit 3 supplies, to a signal line S(i), a source signal Vs which is then transmitted through the source and drain of the TFT 11 and applied as a drain voltage Vd(i,j) to a display electrode 12 which is one of the electrodes of the liquid crystal capacitance $C_{LC}$. A common signal Vcom is applied to an opposite electrode 13 which is the other electrode of the liquid crystal capacitance $C_{LC}$. Thus, a difference between the drain voltage Vd(i,j) and the common signal Vcom is applied to the liquid crystal capacitance $C_{LC}$. As a result, the transmittance or reflectance of liquid crystal 14 sandwiched between the electrodes 12, 13 so changes that an image is displayed by the display cells P in accordance with incoming image data. Switching off the TFT 11 does not cause the displayed image to change immediately, since in the display cell P the charge accumulated in the liquid crystal capacitance $C_{LC}$ is held for a specified period of time.

In liquid crystal displays, liquid crystal would deteriorate in terms of characteristics under continuous application of d.c. voltage to the liquid crystal; to avoid the inconvenience, the liquid crystal is driven by a voltage that changes from positive to negative and vice versa. The method of driving by means of 'inversion drive voltage' is generally termed inversion drive. Different forms of inversion include frame inversion, source line inversion, gate line inversion, and dot inversion.

Assume that the foregoing liquid crystal display is driven by frame inversion drive.

FIG. 19 describes, by means of waveform, development of drive voltages applied to display cells P in the liquid crystal panel 1: namely, the display cell P(i,1) located in the i-th column, $1^{st}$ row, the display cell P(i,j) centrally located in the i-th column, j-th row, and the display cell P(i,J) located in the i-th column, J-th row. For the purpose of simple description, the figure shows an example in which the source signal Vs is steady at 2 V and the common signal Vcom alternates by a 4 V amplitude to create ±2 V drive voltages for application to the display cells P.

Referring to the display cell P(i,1) in the top row, the source signal Vs is written as the TFT 11 is switched on by a gate pulse fed through the scan line G(1) at point A1. With the TFT 11 switched off later, the voltage across the liquid crystal 14 does not change because of the presence of the liquid crystal capacitance $C_{LC}$. Subsequently, the common signal vcom goes negative at point R, varying by an amount equal to the aforementioned amplitude, and the drain voltage Vd varies by the same amount because of the principle of conservation of charge. The source signal Vs is written again as the TFT 11 is switched on by another gate pulse supplied to the scan line G(1) at point B1; the voltage across the liquid crystal 14 is retained. The writing and retaining recurs with a period T in this manner in the display cell P(i,1).

Referring to the central display cell P(i,j), the source signal Vs is written as the TFT 11 is switched on by a gate pulse fed through the scan line G(j) at point Aj; the voltage across the liquid crystal 14 is retained. Subsequently, the common signal Vcom goes negative at point R, varying by an amount equal to the aforementioned amplitude, and the drain voltage Vd varies by the same amount accordingly. The source signal Vs is written again as the TFT 11 is switched on at point Bj; the voltage across the liquid crystal 14 is retained. The writing and retaining recurs in this manner in the display cell P(i,j) similarly to the foregoing.

Referring to the display cell P(i,J) in the bottom row, the source signal Vs is written as the TFT 11 is switched on by a gate pulse fed through the scan line G(J) at point AJ; the voltage across the liquid crystal 14 is retained. Subsequently, the common signal Vcom varies by an amount equal to the aforementioned amplitude at point R, and the drain voltage Vd varies by the same amount. The source signal Vs is written again at point BJ; the voltage across the liquid crystal 14 is retained. The writing and retaining recurs in this manner in the display cell P(i,J) similarly to the foregoing.

As detailed above, the variation of the drain voltage Vd is equal to that of the common signal Vcom. Put it differently, the relative value of the drive voltage $V_{LC}$(i,1) to the common signal Vcom is invariable, for example, in the display cell P(i,1). This makes it possible to drive the display cell (i,1) alternately with voltages ±2 V. The same description holds true with the other display cells P(i,j) and P(i,J).

Now, the following will describe a case where the common signal Vcom is a steady, d.c., voltage.

FIG. 20 describes, by means of waveform, development of drive voltages applied to display cells P in the liquid crystal panel 1: namely, the display cell P(i,1) located in the i-th column, $1^{st}$ row, the display cell P(i,j) centrally located in the i-th column, j-th row, and the display cell P(i,J) located in the i-th column, J-th row. For the purpose of simple description, the figure shows an example in which the common signal Vcom is steady at 2 V and the source signal Vs alternates by a 4 V amplitude to create ±2 V drive voltages for application to the display cell P.

According to this drive scheme, the common signal Vcom does not alternate between positive and negative voltage levels. Therefore, the common signal Vcom does not vary in amplitude, nor does the drain voltage Vd. Further, in a liquid crystal cell P depicted by means of an equivalent circuit in FIG. 17, a change in polarity of the source signal Vs does not lead to a change in polarity of the drain voltage Vd.

Generally, liquid crystal displays require a backlight as a light source, since liquid crystal itself does not emit light by nature. The lamp for the backlight is highly power consuming and makes it difficult to fabricate a power efficient crystal liquid display. In contrast, recently developed reflective displays do not require a backlight and are used in mobile data terminals and other like devices that are mostly used outdoors.

Electrodes used in some liquid crystal displays of this kind have a reflective electrode structure. Some liquid crystal displays employ an alternative structure in which pixel electrodes (reflective electrodes) and bus lines, such as signal lines, are provided in different layers separated by an interlayer insulating film.

In a reflective electrode structure, as shown in FIG. 22, a reflective electrode 12*a*, as a display electrode 12, is positioned to overlap, along its periphery, mutually adjacent signal lines S(i), S(i+1) and scan lines G(j−1), G(j). The structure allows no gap to form between the reflective electrode 12*a* and the signal lines S(i), S(i+1) and the scan lines G(j−1), G(j), thereby preventing light leakage.

FIG. 21 shows an equivalent circuit of the display cell P having the reflective electrode structure. The equivalent circuit includes, as well as the liquid crystal capacitance $C_{LC}$, parasitic capacitances Csd1, Csd2, Cgd1, Cgd2. The parasitic capacitances Csd1, Cgd2 are found between the drain of the TFT 11 and the signal line S(i) and between the drain and the scan line G(j−1) respectively. The parasitic capacitances Csd2, Cgd1 are found between the drain of the TFT 11 and the signal line S(i+1) and between the drain and the scan line G(j) respectively.

However, problems arise if the frame inversion drive laid out in the foregoing is applied to the liquid crystal panel 1 having the reflective electrode structure or the above structure in which pixel electrodes and bus lines are provided in different layers. See Japanese Examined Patent Publication No. 5-2208/1993 (Tokukohei 5-2208; published on Jan. 12, 1993).

FIG. 23 describes, by means of waveform, development of drive voltages applied to display cells P, namely, the display cell P(i,1) in the i-th column, $1^{st}$ row, the central display cell P(i,j) in the i-th column, j-th row, and the display cell P(i,J) in the i-th column, J-th row, in the liquid crystal panel 1 with a reflective electrode structure. For the purpose of simple description, the figure shows, similarly to FIG. 19, an example in which the source signal Vs is 2 V (DC) and the common signal Vcom is 4 V (AC).

In the example of FIG. 19, if the display cell P is retaining the voltage across the liquid crystal, a variation in amplitude of the common signal Vcom leads to a similar variation in amplitude of the drain voltage Vd. This is however not the case with the example of FIG. 23, in which charges are redistributed among the parasitic capacitances Csd1, Csd2, Cgd1, Cgd2. The variation, ΔVd1, of the drain voltage Vd1 is given by equation (1):

$$\Delta Vd1=(C_{LC}/CD)\times Vac1 \quad (1)$$

where CD is a total capacitance connected to the drain electrode of the TFT 11 (=$C_{LC}$+Csd1+Csd2+Cgd1+Cgd2) and Vac1 is a variation of the common signal Vcom.

The voltage retained by the liquid crystal cell P after the common signal Vcom has changed is lower than the otherwise retained standard voltage Vx1 by a fall voltage Vy1 (=Vac1−ΔVd1).

Referring to FIG. 23, a voltage is written to, and a standard voltage Vx1 is retained by, the display cell P during a retaining period Ttrue(j). A change in polarity of the common signal Vcom during a falling period Tfalse(j) leads to a ΔVD1 drop in the voltage of the display cell P from the standard voltage. Thus, the display cells P(i,1), P(i,j), P(i,J) have different retaining periods Ttrue(1), Ttrue(j), Ttrue(J) and different falling periods Tfalse(1), Tfalse(j), Tfalse(J).

Specifically, the drive voltage $V_{LC}$(i,1) in the top row remains low, if ever, for a short falling period Tfalse(1) under the effect of the common signal Vcom, since only writing of a voltage is performed immediately afterwards. In contrast, with a change in polarity of the common signal Vcom immediately after the writing, the drive voltage $V_{LC}$(i,J) in the bottom row remains low for a long falling period Tfalse(J) extending from the change in polarity to the start of a next round of writing.

Each period for writing and retaining for one screen is made of a first period Ta1 extending from the start of the scanning (writing) of the top row to the end of the scanning (writing) of the bottom row, a second period Tb1 extending from the end of the scanning of the bottom row to the polarity change of the common signal Vcom, and a third period Tc1 extending from the polarity change of the common signal Vcom to the start of a next round of scanning. The drive voltage $V_{LC}$(i,1) for the top row remains equal to the standard voltage Vx1 during the first and second periods Ta1, Tb1 and is lower than the standard voltage Vx1 by the fall voltage Vy1 in the third period Tc1. The effective value, $V_{LC}$rms(i,1), of the drive voltage $V_{LC}$(i,1) is given by $$V_{LC}\mathrm{rms}(i,1)=\{((Ta1+Tb1\cdot Vx1^2+Tc1\cdot(Vx1-Vy1)^2)/(Ta1+Tb1+Tc1)\}^{1/2}$$

The drive voltage $V_{LC}$(i,J) for the bottom row remains equal to the standard voltage Vx1 during the second period Tb1 and falls from the standard voltage Vx1 by the fall voltage Vy1 in the first and third periods Ta1, Tc1. The effective value, $V_{LC}$rms(i,J) of the drive signal $V_{LC}$(i,J) is given by $$V_{LC}\mathrm{rms}(i,J)=\{(Tb1\cdot Vx1^2+(Ta1+TC1)\cdot(Vx1-Vy1)^2)/((Ta1+Tb1+TC1)\}^{1/2}$$

Here, Vx1=2 V, Vac1=4 V, $C_{LC}$=4.7 pF, Csd1+Csd2+Cgd1+Cgd2=0.3 pF, CD=5 pF, Ta1=15 mS, Tb1=0.5 mS, and Tc1=0.5 mS. Accordingly, $V_{LC}$rms (i,1)=1.993 Vrms and $V_{LC}$rms(i,J)=1.768 Vrms. The two effective values have a difference of 0.225 Vrms, which means that the effective value of the drive voltage for the display cell P varies 0.225 Vrms, when comparing the top to the bottom of the screen. The difference in the voltage is the cause of unequal brightness between the top and the bottom of the display screen.

The problem does not occur if the common signal Vcom is fixed to a constant d.c. voltage and is thus invariable as mentioned earlier in reference to FIG. 20. However, with the display cell P having a reflective electrode structure of FIG. 21, the source signal Vs changes in polarity with respect to the common signal Vcom for every frame as shown in FIG. 24; therefore the display cells P(i,1), P(i,j), P(i,J) have the periods Tfalse(1), Tfalse(j), Tfalse(J) respectively, which leads to unequal brightness of the display screen similarly to the foregoing case.

With these display cells P, if the source signal Vs changes in polarity with a constant drive voltage $V_{LC}$, charges are redistributed among the parasitic capacitance Csd1, Csd2, Cgd1, Cgd2. Therefore, the display electrode 12 is affected by the parasitic capacitances Csd1, Csd2 located between the drain electrode and the two adjacent signal lines S(i), S(i+1). The variation, ΔVd2, of the drain voltage Vd2 is given by equation (2):

$$\Delta Vd2=\{(Csd1+Csd2)/CD\}\times Vac2 \quad (2)$$

where CD is a total capacitance connected to the drain electrode ($=C_{LC}$+Csd1+Csd2+Cgd1+Cgd2) and Vac2 is a variation of the source signal Vs.

The voltage retained by the display cell P after the source signal Vs has changed is lower than the otherwise retained voltage by ΔVd2. The falling periods Tfalse(1), Tfalse(j), Tfalse(J) which occur due to the voltage fall differ in length as mentioned earlier.

Attention should be paid to that: (i) the drive voltage $V_{LC}$ is not absolute, but always relative to the common signal Vcom; and (ii) if the common signal Vcom changes in polarity, a change in the common signal Vcom leads to a similar change in the potentials (drain potentials) of the opposite electrode 13 and the opposing display electrode 12, and the drive voltage $V_{LC}$ is therefore invariable. The aforementioned inconvenience due to the change in polarity of the common signal Vcom is caused by the common signal Vcom that varies differently depending upon the parasitic capacitances Csd1, Csd2, Cgd1, Cgd2.

If the common signal Vcom is a constant voltage, the common signal Vcom is invariable, and the drain voltage Vd varies depending upon the parasitic capacitance Csd1, Csd2 when the source signal Vs varies. Therefore, undesirable variations of the drive voltage $V_{LC}$ occur.

Each period for writing and retaining for one screen is made of the aforementioned first period Ta1, second period Tb1, third period Tc1. The drive voltage $V_{LC}$(i,1) for the top row remains equal to the standard voltage Vx1 during the first and second periods Ta1, Tb1 and falls from the standard voltage Vx1 by vy1 (=ΔVd2) in the third period Tc1. The effective value, $V_{LC}$rms(i,1), of the drive voltage $V_{LC}$(i,1) is given by $$V_{LC}rms(i,1)=\{((Ta1+Tb1)\cdot Vx1^2+Tc1\cdot(Vx1-Vy1)^2)/(Ta1+Tb1+Tc1)\}^{1/2}$$

The drive voltage $V_{LC}$(i,J) for the bottom row remains equal to the standard voltage Vx during the second period Tb1 and is equal to the difference between the standard voltage Vx1 and the source signal Vd during the first and third periods Ta1, Tc1. Therefore, the effective value, $V_{LC}$rms(i,J), of the drive signal $V_{LC}$(i,J) retained by the display cell P(i,J) is given by $$V_{LC}rms(i,J)=\{(Tb1)\cdot Vx1^2+(Ta1+Tc1)\cdot(Vx1-Vy1)^2/(Ta1+Tb1+Tc1)\}^{1/2}$$

Here, Vx1=2 V, Vac2=4 V, $C_{LC}$=4.7 pF, Csd1+Csd2+Cgd1+Cgd2=0.3 pF, CD=5 pF, Csd1+Csd2=0.15 pF, Ta1=15 mS, Tb1=0.5 mS, and Tc1=0.5 mS. Accordingly, $V_{LC}$rms(i,1)=1.996 Vrms and $V_{LC}$rms(i,J)=1.884 Vrms. The two effective values have a difference of 0.112 Vrms, which means that the effective value of the drive voltage for the display cell P varies 0.112 Vrms, when comparing the top to the bottom of the screen. The difference in the voltage is the cause of unequal brightness between the top and the bottom of the display screen.

SUMMARY OF THE INVENTION

An objective of the invention is to offer an active matrix liquid crystal display and a method of driving the display which allows for reducing the aforementioned difference in brightness that occurs between the top and bottom of the display screen in frame inversion drive.

An active matrix liquid crystal display and a method of driving the display in accordance with the present invention, in order to achieve the objective, are such that:

active elements provided for respective, matrix-forming display cells scan the display cells a scan line at a time for selection;

a signal voltage is written to display electrodes in selected ones of the display cells;

a drive voltage determined by the signal voltage and a common voltage is applied across liquid crystal by applying the common voltage to an opposite electrode positioned opposite to the display electrodes; and either one of the common voltage and the signal voltage changes in polarity with respect to the common voltage in each frame, wherein:

non-scanning means provides a non-scan period during which the signal voltage is retained and no new signal voltage is written, immediately following a scan period in which the signal voltage is written to some of the display cells corresponding to one screen, the non-scan period being equal to or longer than the scan period; and inversion control means changes either one of the common voltage and the signal voltage in polarity with respect to the signal voltage in the non-scan period.

In frame inversion drive, as mentioned earlier, the parasitic capacitance that develops in the display cell have negative effects: for example, the effective value of the voltage applied across the liquid crystal falls. The effects vary from line to line of the display screen, and this leads to irregular brightness of the display image. To address these problems, a non-scan period which is equal to or longer than the scan period is provided immediately following the scan period, and this causes the display cells to retain a standard drive voltage during the non-scan period. The difference in effective value of the voltage level applied to the display cells is greatly reduced between the top and bottom rows of the display screen, and the difference in brightness between these two rows are in practice eliminated.

For a fuller understanding of the nature and advantages of the invention, reference should be made to the ensuing detailed description taken in conjunction with the accompanying drawings.

DESCRIPTION OF THE EMBODIMENTS

[Embodiment 1]

The following will describe embodiment 1 in accordance with the present invention in reference to FIGS. 1–7, 17, 18, 21, and 22.

Figure 1:
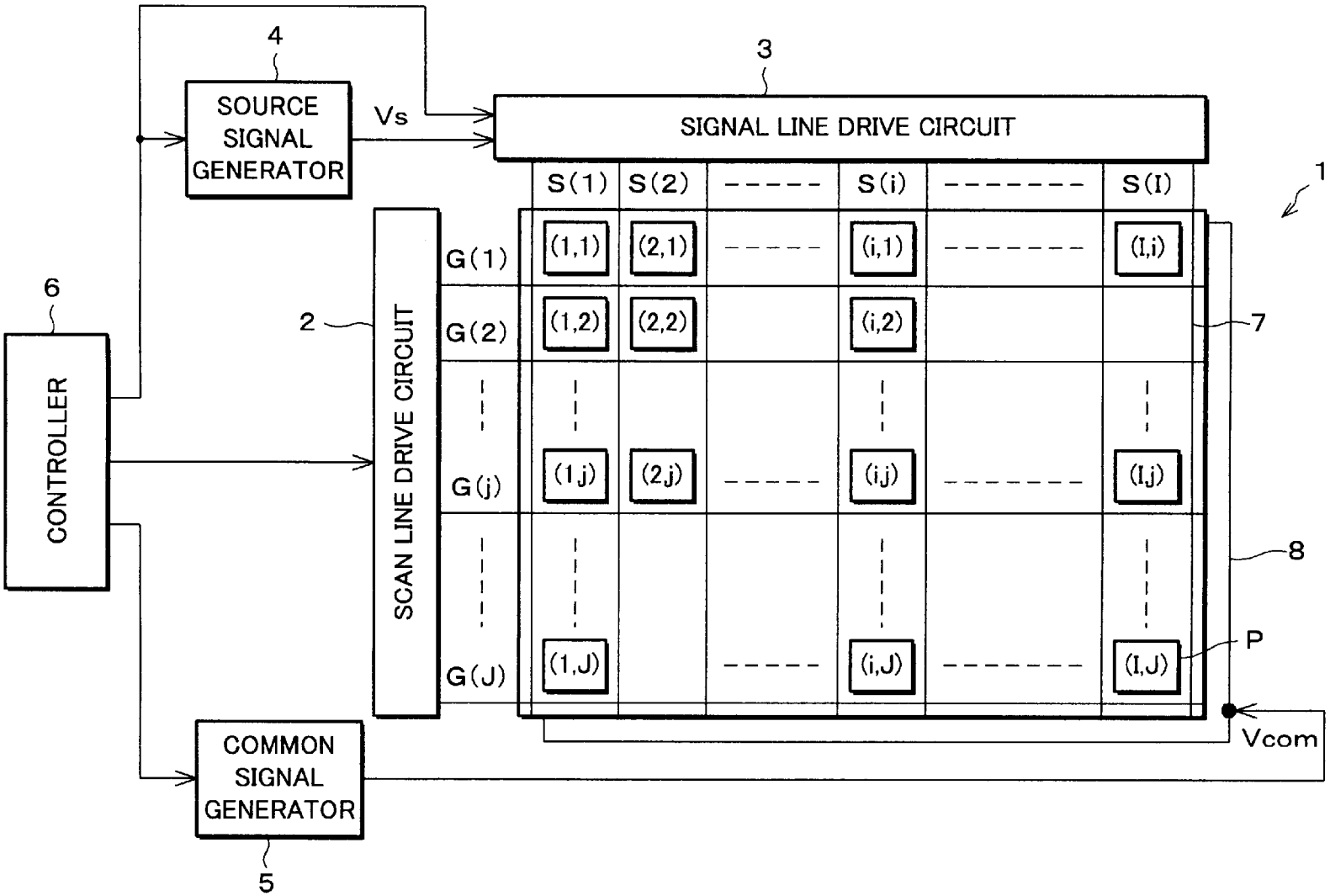
FIG. 1 is a block diagram showing an arrangement of a liquid crystal display of embodiments 1, 2 in accordance with the present invention.

A liquid crystal display of the present embodiment is composed of a liquid crystal panel 1, a scan line drive circuit 2, and a signal line drive circuit 3 similarly to the foregoing conventional liquid crystal display, and further includes a source signal generator 4, a common signal generator 5, and a controller 6 as shown in FIG. 1.

The liquid crystal panel 1 includes a matrix substrate 7, an opposite substrate 8 positioned parallel and opposing to the substrate 7, and liquid crystal (not shown) injected between the substrates 7, 8. On the matrix substrate 7 are there provided multiple scan lines G(1) . . . G(J) and signal lines S(1) . . . S(I) that cross each other, as well display cells P arranged in a matrix.

Figure 17:
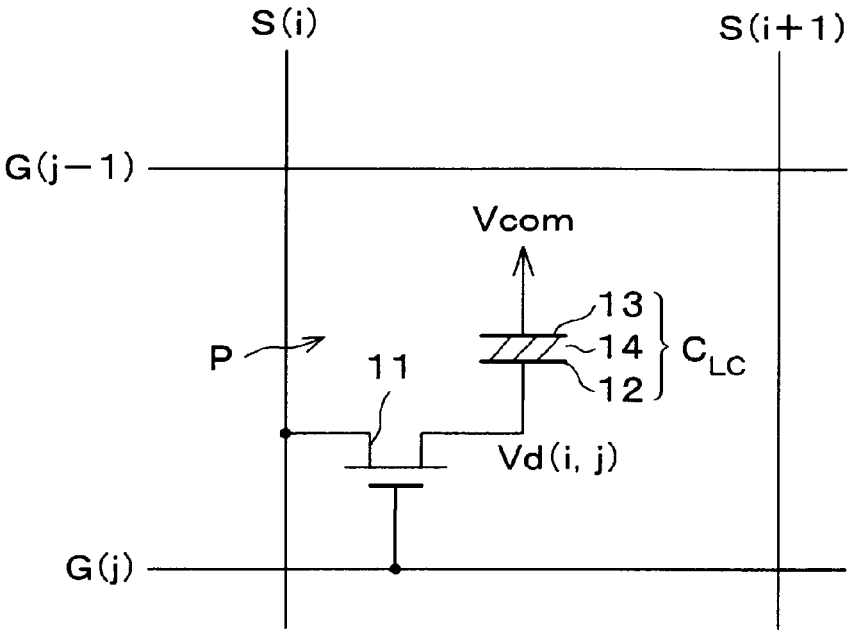
FIG. 17 is a equivalent circuit diagram showing an arrangement of a display cell in a liquid crystal display; the arrangement is commonly employed both conventionally and in the present invention.
Figure 18:
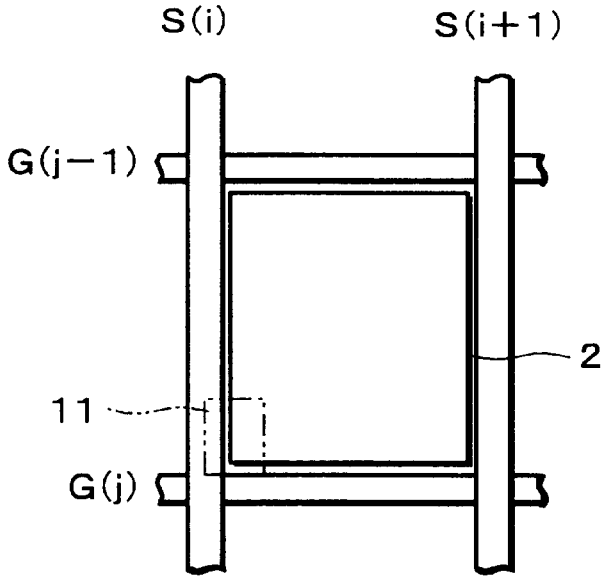
FIG. 18 is a plan view showing a structure of electrodes of a display cell of FIG. 17.
Figure 19:
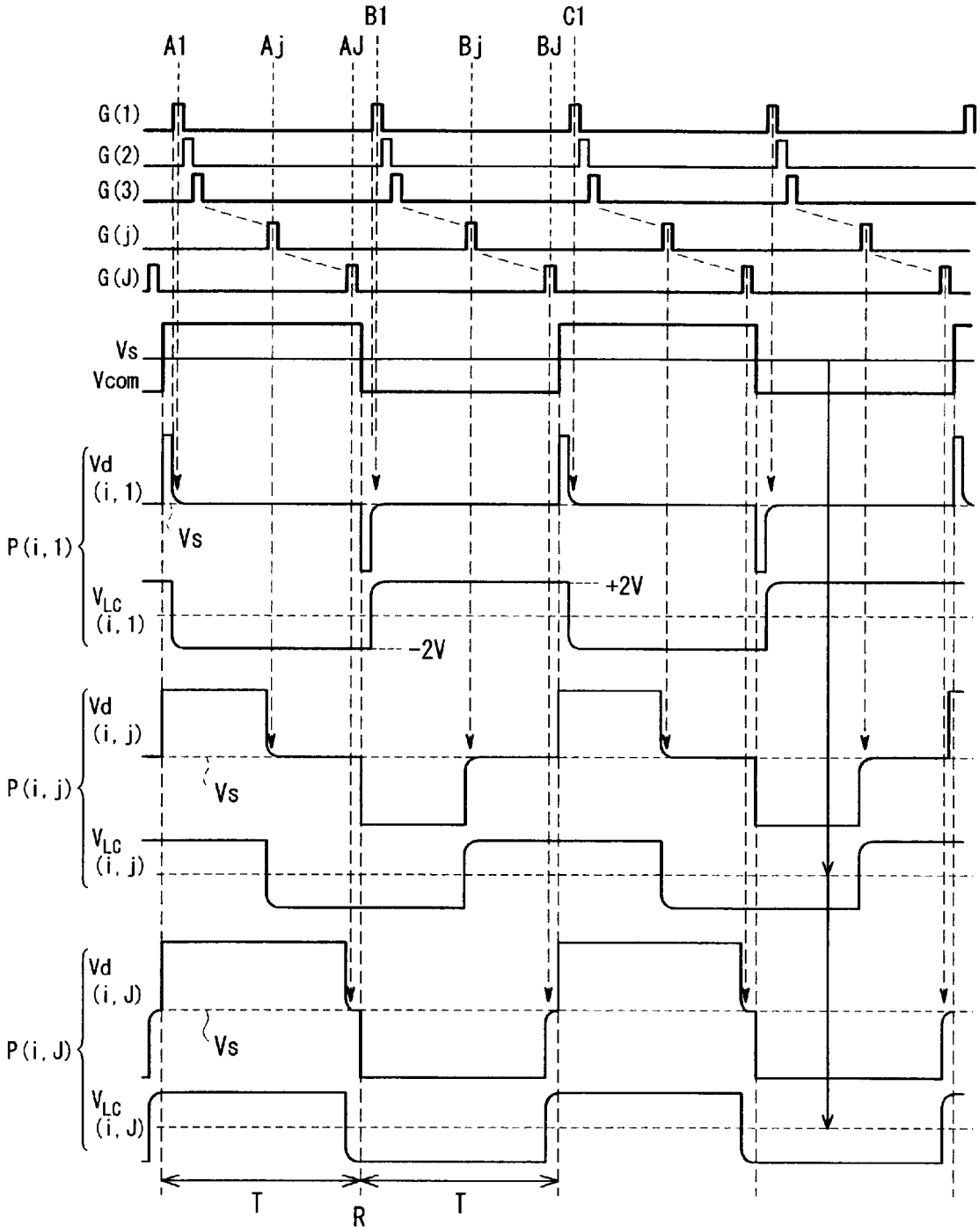
FIG. 19 is a waveform diagram showing a driving operation of a liquid crystal display incorporating the display cell of FIG. 17 in which a common signal changes in polarity.
Figure 20:
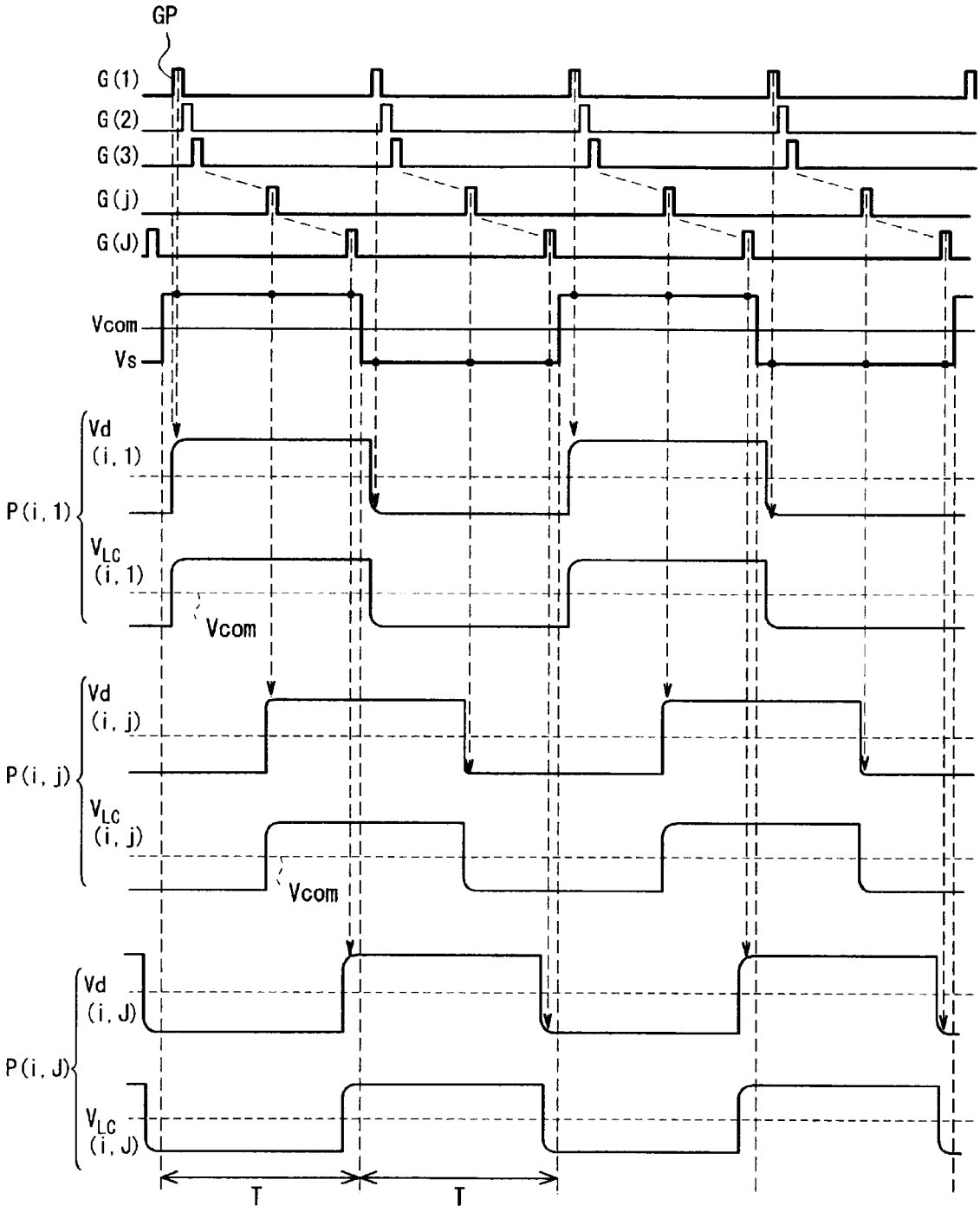
FIG. 20 is a waveform diagram showing a driving operation of a liquid crystal display incorporating the display cell of FIG. 17 in which a source signal changes in polarity.

As shown in FIGS. 17, 18, the display cell P is formed in an area surrounded by two adjacent scan lines G(j), G(j−1) and two adjacent signal lines S(i), S(i+1). Each display cell P has a thin film transistor (hereinafter, TFT) 11, which is a switching element, and a liquid crystal capacitance $C_{LC}$. The TFT 11 is connected at its gate to the scan line G(j) and at its source to the signal line S(i). The liquid crystal capacitance $C_{LC}$ is formed of a display electrode 12 for connection to the TFT 11 an opposite electrode 13 positioned opposite to the electrode 12, and liquid crystal 14 sandwiched between the electrodes 12, 13. The opposite electrode 13, as a common electrode, is provided on the opposite substrate 8 so that it is commonly shared by all the display cells P.

In the display cell P, the display electrode 12 is connected to the signal line S(i) through the drain and source of the TFT 11, and the gate of the TFT 11 is connected to the scan line G(j). The opposite electrode 13 is fed with a common signal Vcom from the common signal generator 5. Thus, a difference between a positive or negative peak of the source (voltage) signal Vs supplied through the signal lines S(i) during an ON period of the TFT 11 and a positive or negative peak of the common (voltage) signal Vcom is applied to the liquid crystal capacitance $C_{LC}$. As a result, the transmittance or reflectance of the liquid crystal so changes that an image is displayed by the display cells P in accordance with incoming image data. Switching off the TFT 11 does not cause the displayed image to change immediately, since in the display cell P the charge accumulated in the liquid crystal capacitance $C_{LC}$ is held for a specified period of time.

The scan line drive circuit 2 shifts a starting pulse fed from the controller 6 based on timings of a clock and supplies gate pulses GP (will be detailed later; see FIG. 4) through a buffer circuit to selectively address the scan lines G(1) . . . G(J). The signal line drive circuit 3 shifts a starting pulse fed from the controller 6 based on timings of a clock and samples and holds the source signal Vs fed from the source signal generator 4 based on the shifted pulses to supply a source signal Vs to each signal line S(1) . . . S(I) through a buffer circuit.

Figure 2:
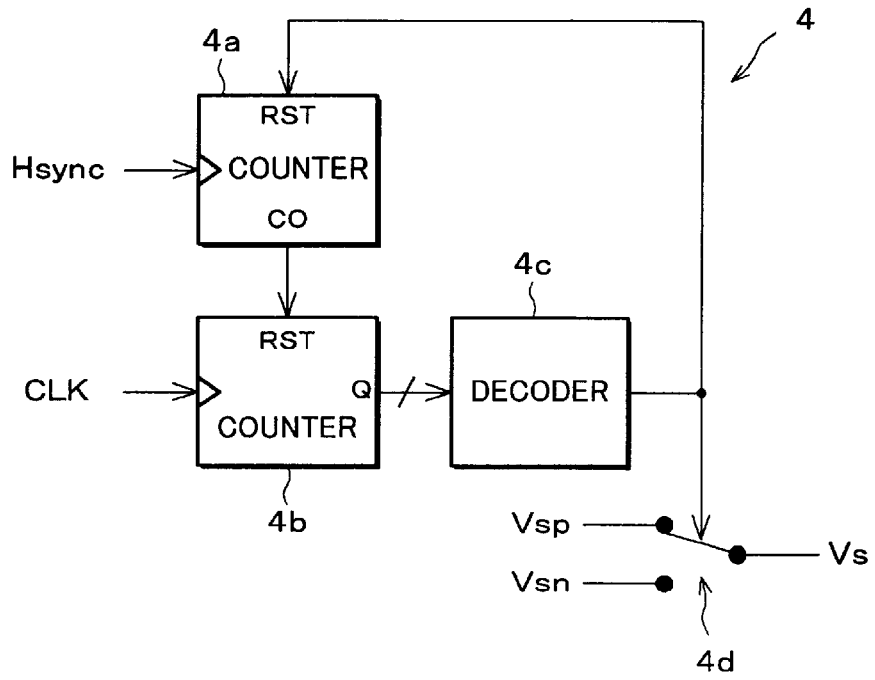
FIG. 2 is a block diagram showing an arrangement of a source signal generator in the liquid crystal display.

The source signal generator 4 produces a source signal Vs that changes in polarity for every frame and is, to this end, equipped with counters 4*a*, 4*b*, a decoder 4*c*, and a switch 4*d* as shown in FIG. 2.

The counter 4*a* counts horizontal synchronization signals Hsync fed from the controller 6. As the number of horizontal synchronization signal Hsync reaches a number specified for a scan period (detailed later), the counter 4*a* outputs a carry signal CO. The counter 4*a* is reset by a LOW decoder signal fed from the decoder 4*c*. The counter 4*b* counts a clock CLK fed from the controller 6 and is reset by the carry signal CO fed from the counter 4*a*.

As the count fed from the counter 4*b* reaches a predetermined value that is in accordance with the timings of polarity changes of the common signal Vcom, the decoder 4*c* outputs a LOW decoder signal. The decoder 4*c* is formed of various logic circuits so that it can output a LOW (or HIGH) decoder signal in response to incoming multiple bit data representative of the predetermined value. The switch 4*d* is of an alternative type for switching the source signal Vs between a positive voltage Vsp and a negative voltage Vnp for output when the decoder signal goes LOW.

In the source signal generator 4 thus arranged, the counter 4*a* counts the horizontal synchronization signals Hsync each received for a different line. As the scanning operation on the scan lines G(1) . . . G(J) is completed for one frame, the counter 4*a* outputs the carry signal CO which resets the counter 4*b*. Once reset, the counter 4*b* starts counting the clock CLK and outputs the count at a data output terminal Q. As the clock CLK count by the counter 4*b* reaches a predetermined value, the decoder 4*c* outputs a LOW decoder signal based on data representative of the value. This causes the switch 4*d* to be connected either to the voltage Vsp or the voltage Vnp as the source signal Vs for output. The counter 4*a,* once reset by the decoder signal, stands by before another incoming horizontal synchronization signal Hsync.

This way, the source signal generator 4 outputs the source signal Vs that changes in polarity in each frame.

Figure 3:
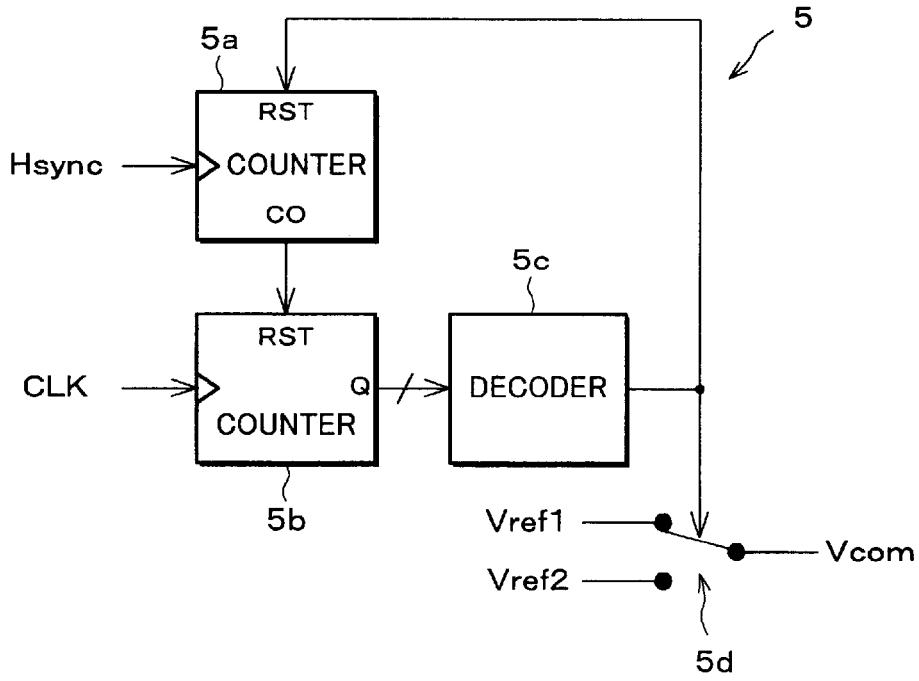
FIG. 3 is a block diagram showing an arrangement of a common signal generator in the liquid crystal display.

The common signal generator 5 produces a common signal Vcom that changes in polarity in each frame. The common signal Vcom has the same cycle as the source signal Vs and changes in polarity in phase with, or 180° C. out of phase from, the source signal Vs. The common signal generator 5 is, to this end, equipped with counters 5*a,* 5*b,* a decoder 5*c,* and a switch 5*d* as shown in FIG. 3.

The common signal generator 5 has a similar structure to that of the source signal generator 4, but differs from the source signal generator 4 in that the switch 5*d* switches the common signal Vcom between a positive voltage Vref1 and a negative voltage Vref2 for output. Similarly to the case with the source signal generator 4, in the common signal generator 5, when the counter 5*a* completes counting of the horizontal synchronization signal Hsync, the counter 5*b* starts counting the clock CLK. As the count reaches a predetermined value, the switch 5*d* switches the common signal Vcom in accordance with a change in the decoder signal fed from the decoder 5*c*. This way, the common signal generator 5 outputs the common signal Vcom that changes in polarity in each frame.

Accordingly, the period (second period Tb2, which will be detailed below) extending from the time when a scanning operation on the scan lines G(1) . . . G(J) is completed for one frame to the time when the source signal Vs or common signal Vcom changes in polarity is determined by the count (predetermined value) made by the counters 4*b,* 5*b* when the decoders 4*c,* 5*c* outputs a decoder signal to cause the switches 4*d,* 5*d* to move to a different position. This way, the source signal generator 4 and the common signal generator 5 function as inversion control means.

The controller 6, which is a system controller including a CPU and other components, generates various control signals supplied to the scan line drive circuit 2, source signal generator 4, and common signal generator 5, including the foregoing clock CLK, horizontal synchronization signal Hsync, vertical synchronization signal Vsync, starting pulse, etc. The controller 6 sets a timing to transmit a starting pulse to the scan line drive circuit 2 so that a scan period (first period Ta2 in FIG. 4) and a non-scan period (second and third periods Tb2, Tc2 in FIG. 4) during which no scanning is performed occur alternately. The scan period is composed of the first period Ta2, during which the 1st to J-th gate pulses GP are sequentially output to address (scan) the scan lines G(1) . . . G(J) a line at a time. The non-scan period is specified to be longer than the scan period. This way, the controller 6 functions as non-scanning means.

It is now described how to drive the liquid crystal display arranged in the above manner. Although the source signal Vs used in the liquid crystal display of the present invention changes in polarity, it is assumed in the following example that the source signal Vs is a constant d.c. voltage for the purpose of simple description.

Figure 4:
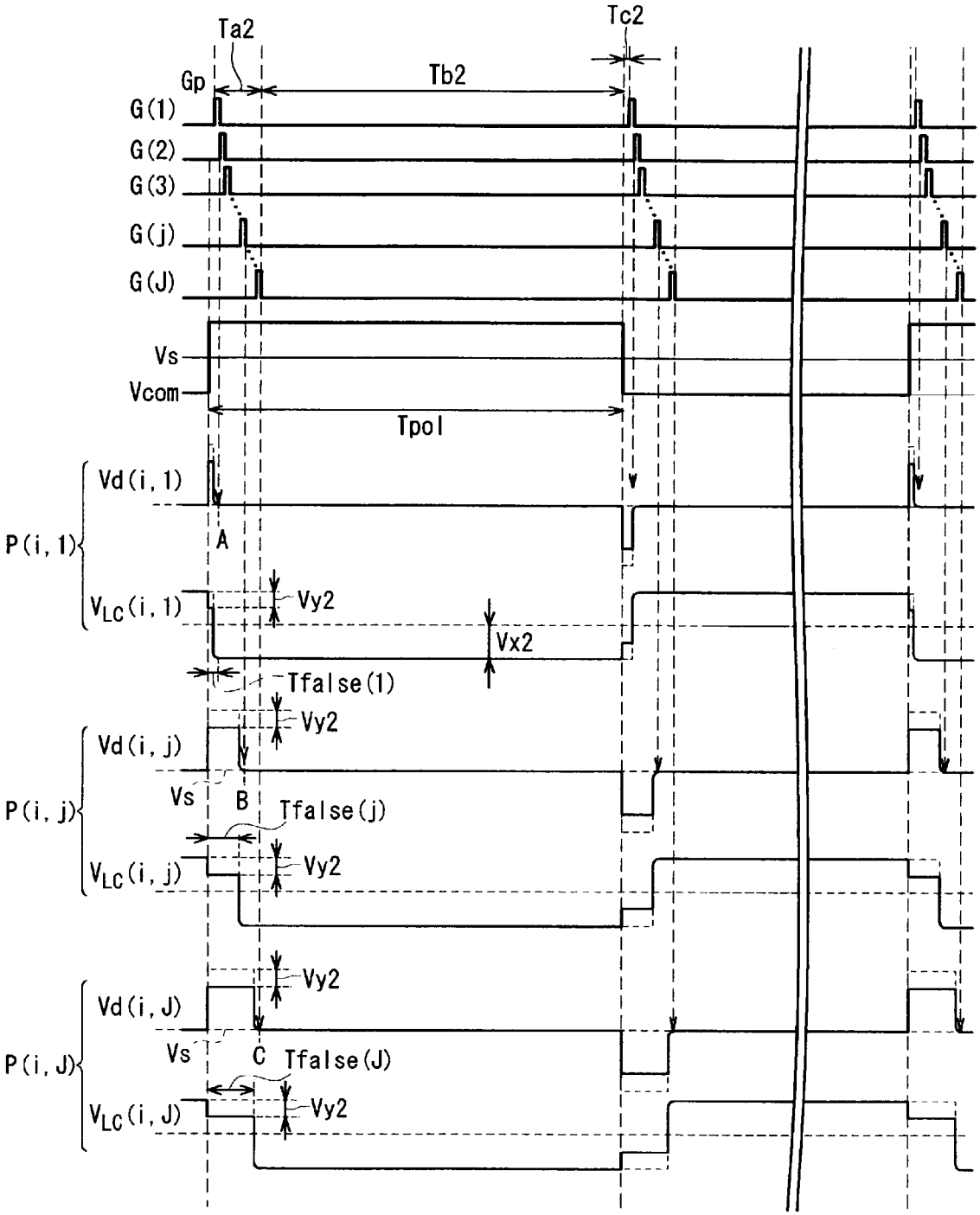
FIG. 4 is a waveform diagram showing a common signal changing in polarity to drive the liquid crystal display.

FIG. 4 describes, by means of waveform, development of drive voltage applied to display cells in the liquid crystal panel 1: namely, the display cell P(i,1) located in the i-th column, $1^{st}$ row, the display cell P(i,j) centrally located in the i-th column, j-th row, and the display cell P(i,J) located in the i-th column, J-th row. The figure shows an example in which the source signal Vs is steady at 2 V and the common signal Vcom alternates by a 4 V amplitude to create ±2 V drive voltages for application to the display cells P.

A refresh period Tpol for writing and retaining for one screen is formed of the first period Ta2, the second period Tb2, and the third period Tc2. The first period Ta2 extends from the start of the scanning (writing) of the top row to the end of the scanning (writing) of the bottom row. The second period Tb2 extends from the end of the scanning of the bottom row to the polarity change of the common signal Vcom with respect to the source signal Vs. The third period Tc2 extends from the polarity change of the common signal Vcom to the start of a next round of scanning.

Referring to the display cell P(i,1) in the top row, the drain voltage Vd changes in accordance with the common signal Vcom concurrently with the polarity change of the common signal Vcom at the end of the preceding second period Tb2 (not shown). The voltage retained by the liquid crystal cell P after the common signal Vcom has changed is lower than the otherwise retained standard voltage Vx2 by a fall voltage Vy2 as described earlier in BACKGROUND OF THE INVENTION. In the succeeding first period Ta2, the source signal (voltage) Vs is written as the TFT 11 is switched on by a gate pulse GP fed through the scan line G(1) at point A, which renders the drain voltage Vd equal to the signal voltage. With the TFT 11 switched off later, the voltage across the liquid crystal does not change because of the presence of the liquid crystal capacitance $C_{LC}$. The retained drive signal $V_{LC}$(i,1) also falls by a voltage Vy, as does the drain voltage Vd.

With the scan period, i.e., the first period Ta2, coming to an end, the voltage level of the drive signal $V_{LC}$(i,1) is retained during the succeeding second period Tb2, since no scanning is performed during the period. With the scan signal Vcom changing in polarity at the end of the second period Tb2, the drain voltage Vd changes similarly as described in the foregoing. This way, an image is written and retained in each frame.

Referring to the central display cell P(i,j), the falling period Tfalse(j) extending from the time when the drain voltage Vd changes in level concurrently with the polarity change of the common signal Vcom at the end of the preceding second period Tb2 (not shown) to the time when the source (voltage) signal Vs written (at point B) is longer than the falling period Tfalse(1) of the display cell P(i,1). Referring to the display cell P(i,J) in the bottom row, the falling period Tfalse(J) (period extending form the polarity change of the common signal Vcom to point C) is longer than the falling period Tfalse(j).

Figure 5:
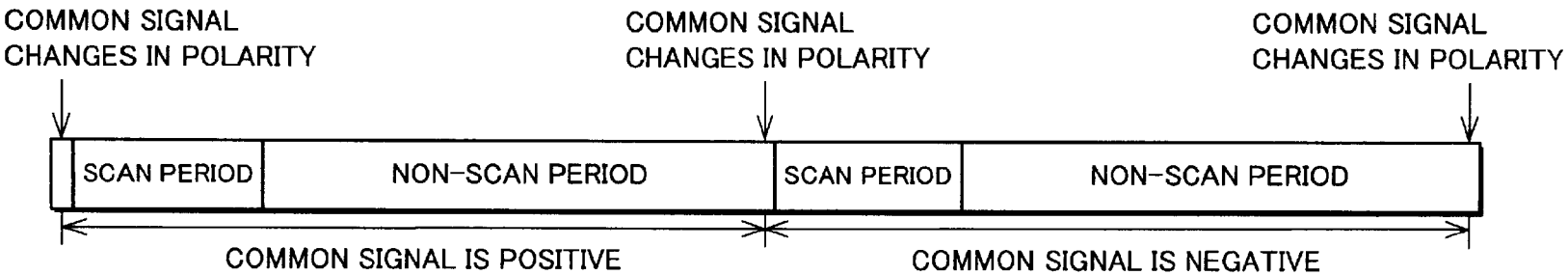
FIG. 5 is an explanatory drawing depicting the concept of the driving operation.
Figure 6:
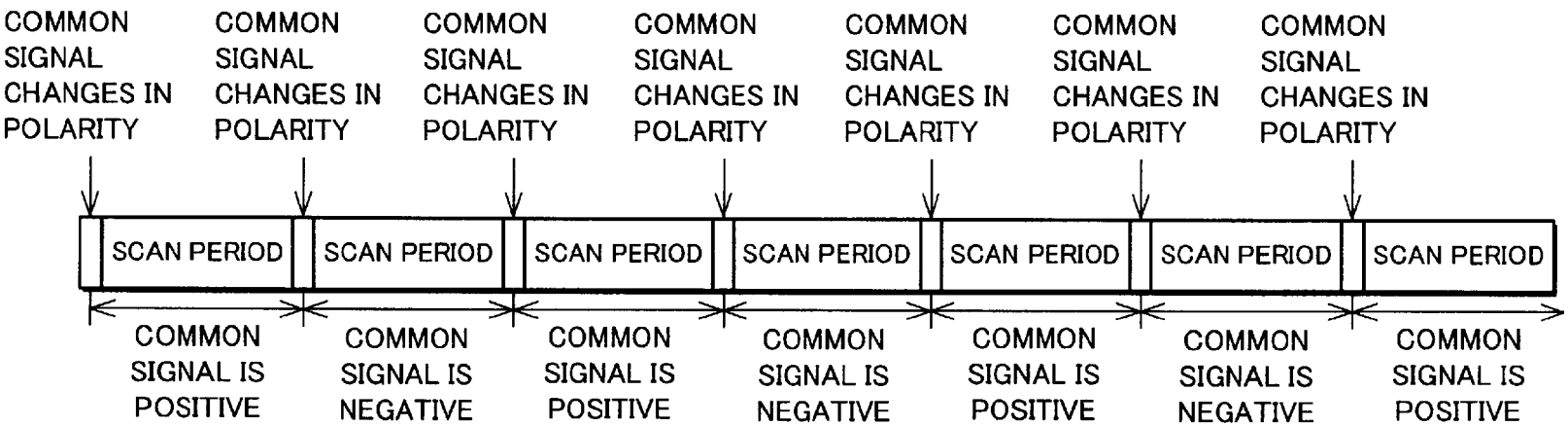
FIG. 6 (PRIOR ART)
FIG. 6 is an explanatory drawing depicting the concept of a driving operation based on a conventional drive scheme for comparison.

Meanwhile, in the refresh period Tpol for writing and retaining for one frame is there provided a non-scan period (second and third periods Tb2, Tc2) following a scan period (first period Ta2) as shown in FIG. 5, and the common signal Vcom changes in polarity at the end of the second period Tb2. The voltage retained by the display cells P during the non-scan period ensures brightness. This allows for reduced differences in brightness among the top, middle, and bottom rows as shown in FIG. 6, in comparison with conventional drive schemes with no non-scan periods.

An observer examined an image display on the present liquid crystal display and evaluated its display quality, while varying the ratio in length of the non-scan period to the scan period to 0, 0.5, 1.0, 1.5, 5, and 10. Evaluation was graded in "Poor" (unsuitable for practical use), "Moderate", "Good", and "Very Good". Table 1 shows the results. It would be understood from the table that the non-scan period should be equal to or longer than the scan period to obtain satisfactory display quality.

TABLE 1

| n | 0 | 0.5 | 1 | 1.5 | 5.0 | 10 |
|---|---|---|---|---|---|---|
| Quality | Poor | Moderate | Good | Good | Very Good | Very Good |

As described above, in the present liquid crystal display, satisfactory display quality can be achieved if the non-scan period is equal to or longer than the scan period. It should be noted however that the display quality is negatively affected by the end of the second period Tb2 during which the common signal Vcom changes in polarity, that is, the length of the second period Tb2. At whatever timing the common signal Vcom may change in polarity, row-to-row differences in brightness can be reduced so long as the ratio of the non-scan and scan periods satisfy the above relationship. Nevertheless, for example, in the case of a liquid crystal display of normally white mode, the closer the timing of polarity change is moved to the start of the second period Tb2 (i.e., the shorter the second period Tb2), the higher the overall brightness of the display image and the brighter the whole image; the original brightness of the display image is not obtainable. Considering these contributing factors, to produce satisfactory brightness, the common signal Vcom should change in polarity in the latter half of the non-scan period which is equivalent to the second and third periods Tb2, Tc2 combined, and the second period Tb2 should be extended backwards so that the timing of the polarity change is as close to (preferably immediately before) the start of the third period Tc2 as possible.

Figure 21:
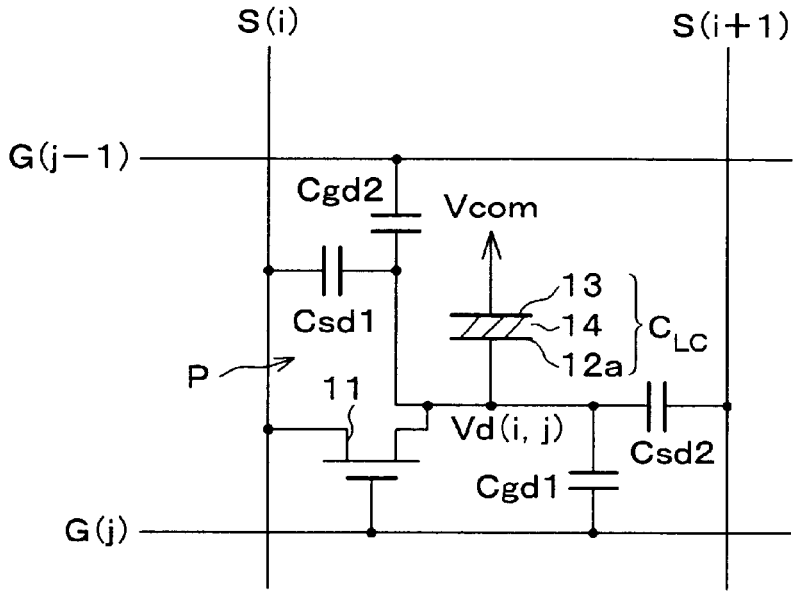
FIG. 21 is an equivalent circuit diagram showing a reflective electrode structure of a display cell in a liquid crystal display; the structure is commonly employed both conventionally and in the present invention.
Figure 22:
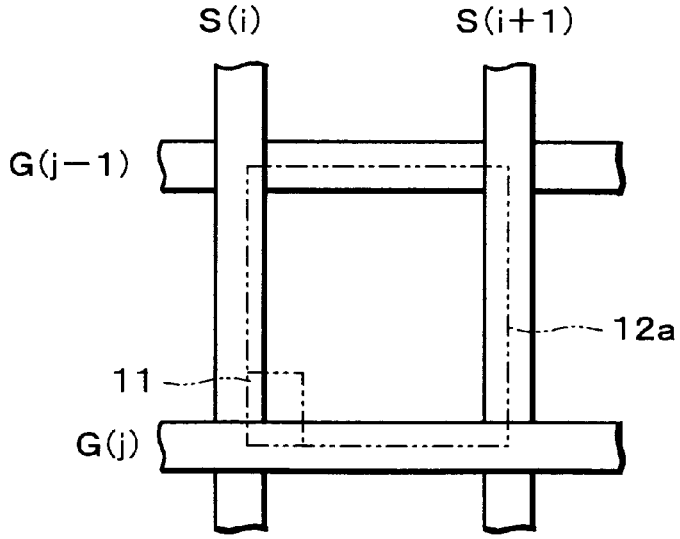
FIG. 22 is a plan view showing a structure of electrodes in the display cell of FIG. 21.
Figure 23:
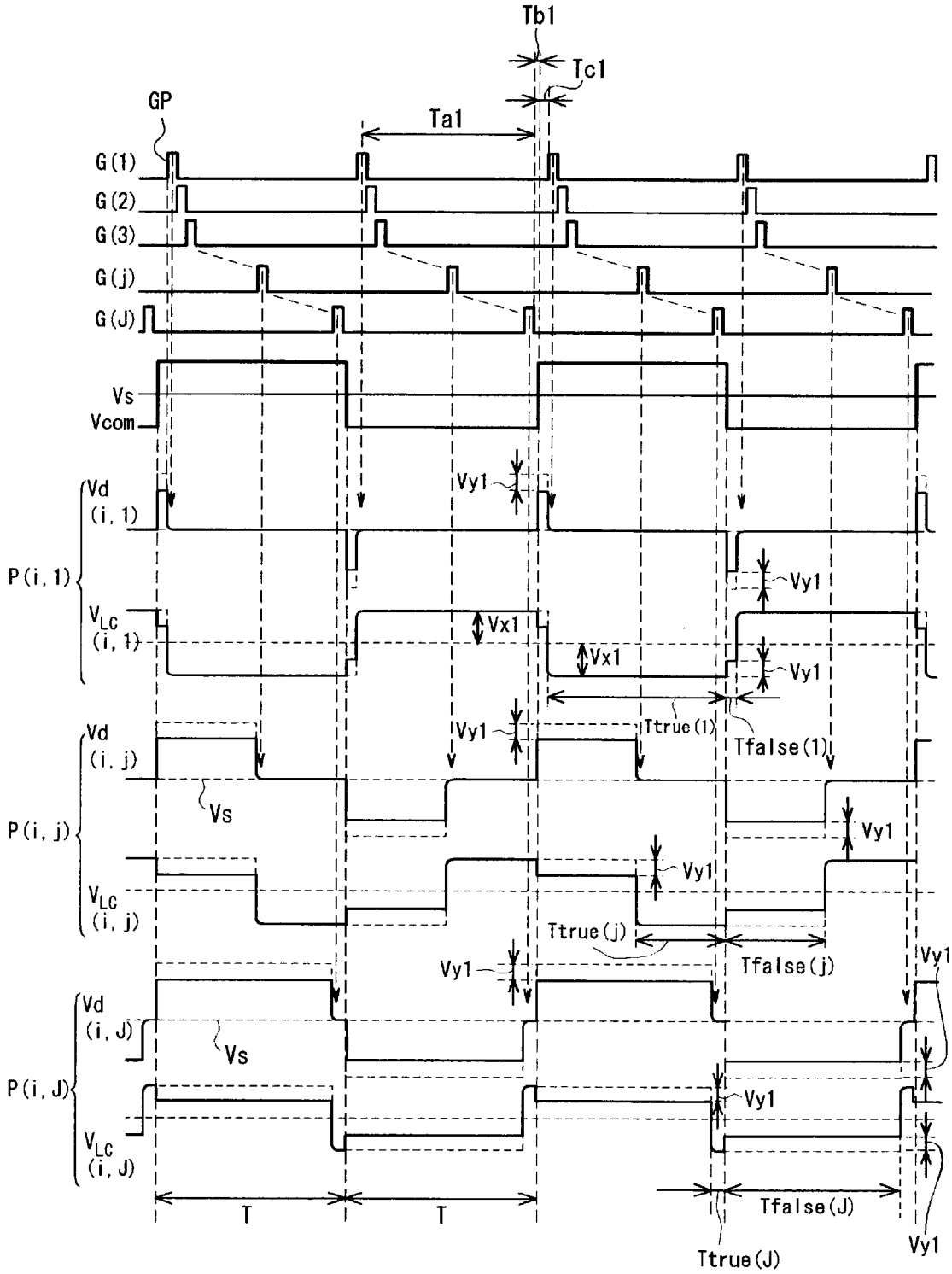
FIG. 23 is a waveform diagram showing a driving operation of a liquid crystal display incorporating the display cell of FIG. 21 in which a common signal changes in polarity.
Figure 24:
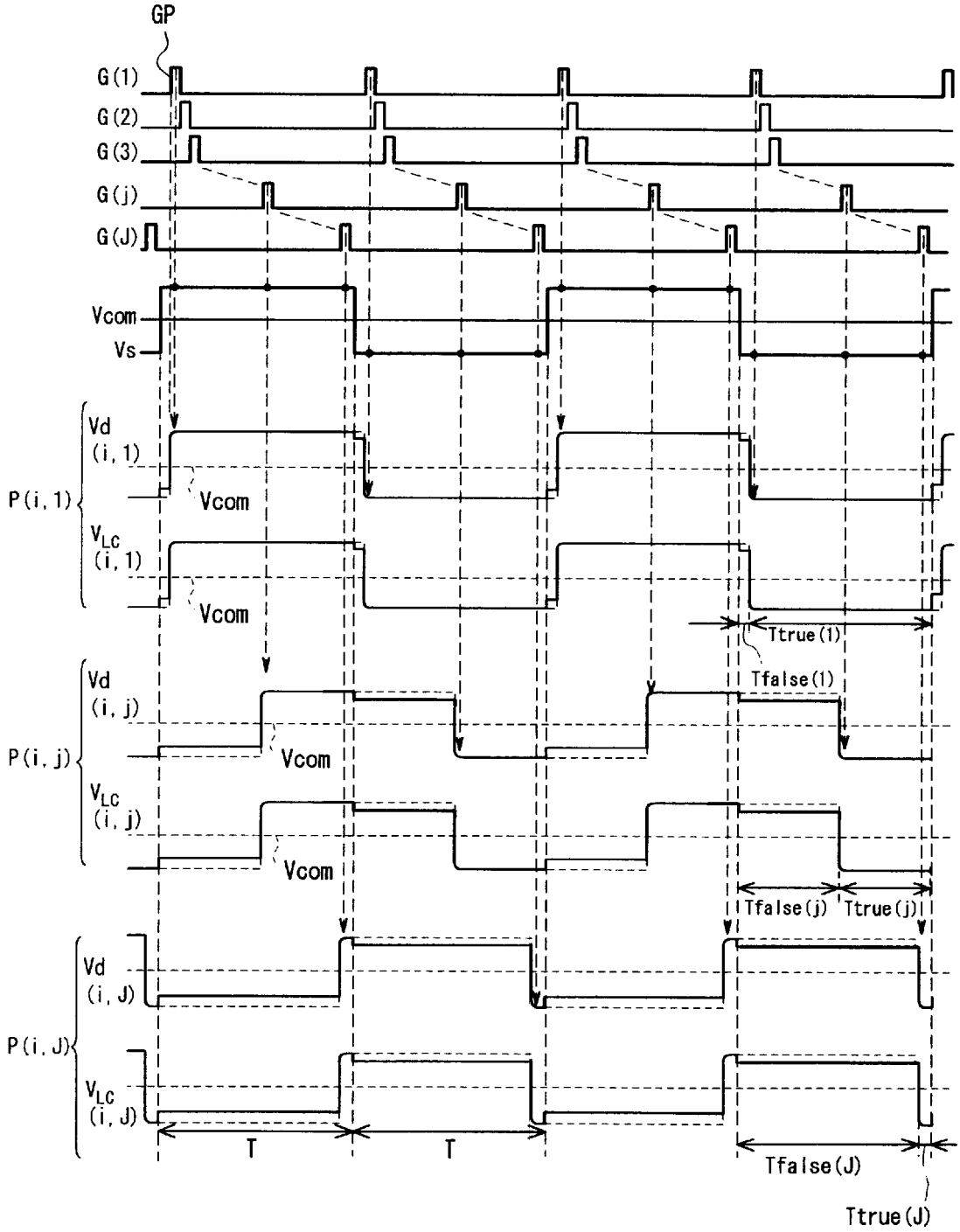
FIG. 24 is a waveform diagram showing a driving operation of a liquid crystal display incorporating the display cell of FIG. 21 in which a source signal changes in polarity.

Now, referring to the present liquid crystal display, in the liquid crystal panel 1 with a reflective electrode structure shown in FIG. 21 and FIG. 22, the drive signal $V_{LC}$(i,1) for the top row remains equal to the standard voltage Vx2 during the first and second periods Ta2, Tb2 as shown in FIG. 4 and falls from the standard voltage Vx2 by a fall voltage Vy2, as given by equation (1) , in the third period Tc2. The effective value, $V_{LC}$rms(i,1), of the drive signal $V_{LC}$(i,1) is given by equation (3):

$$V_{LC}rms(i,1)=\{((Ta2+Tb2)\cdot Vx2^2+Tc2\cdot(Vx2-Vy2)^2)/(Ta2+Tb2+Tc2)\}^{1/2} \quad (3)$$

The drive signal $V_{LC}$(i,J) for the bottom row remains equal to the standard voltage Vx2 during the second period Tb2 and falls from the standard voltage Vx2 in the first and third period Ta2, Tc2 by the fall voltage Vy2. The effective value, $V_{LC}$rms(i,J) of the drive signal $V_{LC}$(i,J) is given by equation (4):

$$V_{LC}rms(i,J)=\{(Tb2\cdot Vx2^2+(Ta2+Tc2)\cdot(Vx2-Vy2)^2)/(Ta2+Tb2+Tc2)\}^{1/2} \quad (4)$$

Here, Vx2=2 V, Vac1 (amplitude of the common signal Vcom)=4 V, $C_{LC}$=4.7 pF, Csd1+Csd2+Cgd1+Cgd2=0.3 pF, CD=5 pF, Ta2=15 mS, Tb2=160 mS, Tc2=0.5 mS. Accordingly, $V_{LC}$rms(i,1)=1.999 Vrms and $V_{LC}$rms(i,J)=1.980 Vrms. The two effective values have a difference of 0.02 Vrms, which means that the effective value of the drive voltage for the display cell P varies a maximum of 0.02 Vrms, when comparing the top to the bottom of the screen. The difference of voltage is hence sufficiently restrained to produce substantially equal brightness between the top and the bottom of the display screen.

Figure 7:
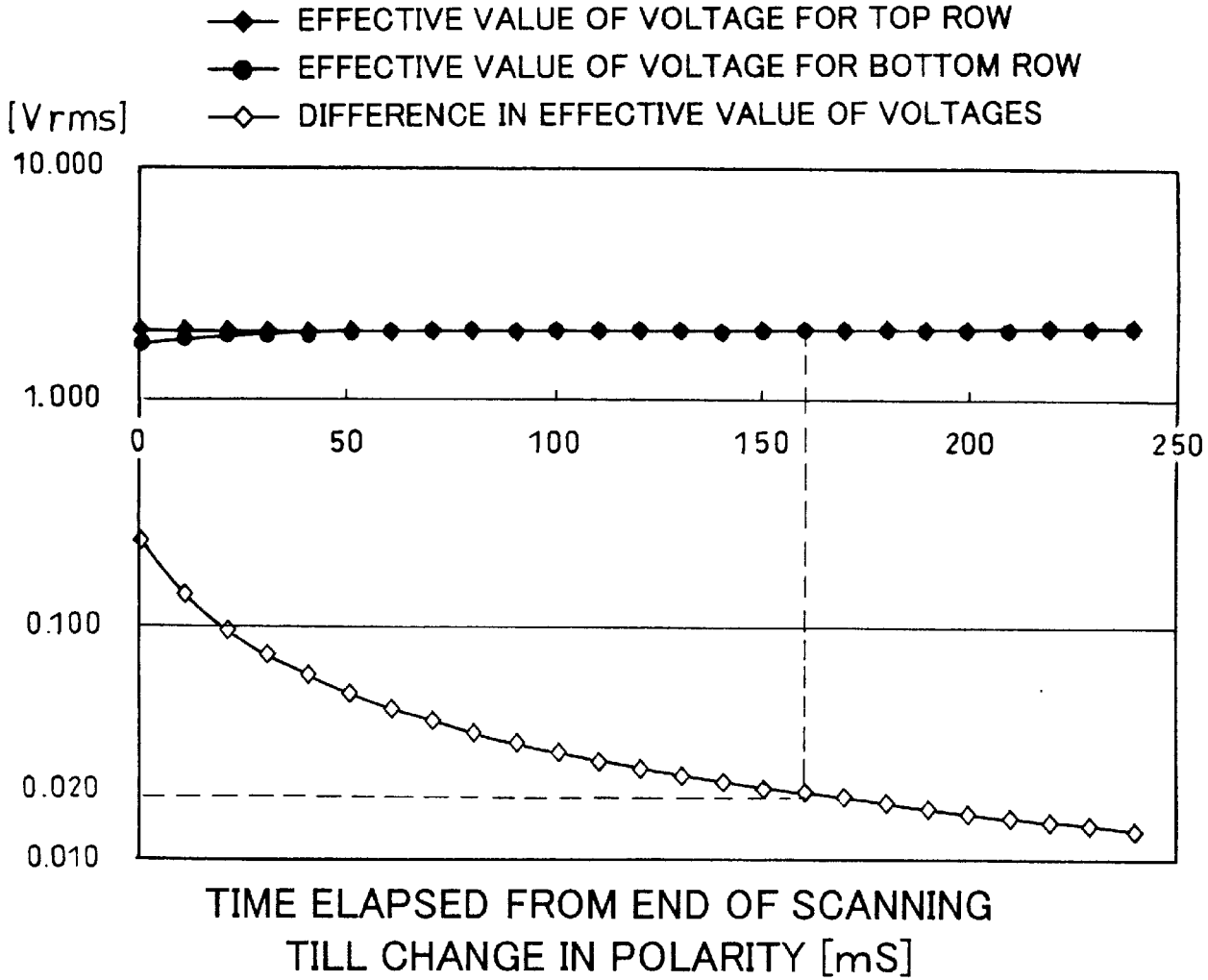
FIG. 7 is a graph showing the relationship between the timings of polarity change of a common signal of the liquid crystal display and an effective value of a drive (voltage) signal for the top and bottom rows of the display screen.

FIG. 7 is a graph showing the relationship between the duration of the second period Tb2 extending from the end of the first period Ta2 to the polarity change of the common signal Vcom and the difference in effective value of the voltage level of the drive signal $V_{LC}$between the top and bottom rows, where Vx2=2 V, VaCl=4 V, $C_{LC}$=4.7 pF, Csd1+Csd2+Cgd1+Cgd2=0.3 pF, CD=5 pF, Ta2=15 mS, Tc2=0.5 mS. Effective values of voltages are expressed in logarithm on the vertical axis. From the graph, it is understood that the second period Tb2 is 160 mS when the difference in effective value of the voltage level is about 0.02 Vrms.

As described in the foregoing, with the liquid crystal display of the present embodiment, a novel non-scan period (second and third periods Tb2, Tc2) equal to or longer than the scan period is provided immediately following the scan period (first period Ta2). This remarkably reduces the difference in effective value of the voltage level applied to the display cell P between the top and bottom rows of the display screen, practically eliminating differences in brightness between the top and bottom rows. This produces in practice uniform brightness all across the display screen, effectively improving the display quality of the liquid crystal display.

Further, the common signal Vcom is specified to change in polarity in the latter half of the non-scan period; reproduction of the original brightness is thereby ensured to a satisfactory degree. Especially, if the polarity change occurs immediately before the end of the non-scan period, reproduction of the original brightness is almost fully ensured. This further improves the display quality of the liquid crystal display.

When the present liquid crystal display is used in a television system, since an NTSC signal has a standardized frame frequency of 30 Hz (however, in this case, the field frequency is 60 Hz, and the polarity change occurs with a field frequency according to frame inversion), a high speed scanning is preferably carried out in the first period Ta2 to ensure a sufficiently long second period Tb2. The ratio of the first and second periods Ta2, Tb2 can be specified relatively easily with a liquid crystal display in comparison with the CRT, because the former does not need the vertical blanking period to reposition the electron gun from the bottom row to the top row for a new scanning. A still image can be displayed with several fields skipped since the image does not change from field to field. The aforementioned advantages of the present invention are also available with a still image by causing the first period Ta2 to correspond to a skipped field, even if the scanning is done at a normal speed in the first period Ta2.

Assuming that the present liquid crystal display is built in a mobile information terminal, such as a mobile phone, to display a still image or animation with little movement, the frame frequency can be specified to a low value, such as 5 Hz or 10 Hz, unlike with a television set. A long duration can be allocated to the second period Tb2 without carrying out a high speed scanning in the first period Ta2.

As mentioned earlier, the liquid crystal display with a reflective electrode structure can be suitably used with the mobile information terminal. The liquid crystal display is susceptible to a voltage fall because of the presence of the parasitic capacitances Csd1, Csd2, Cgd1, Cgd2, since the display electrodes 12 overlap the scan lines G(i), G(i−1) and the signal lines S(i), S(i+1) as shown in FIG. 21. The drive method above can solve this problem and achieves satisfactory display quality. The structure of the liquid crystal panel 1, when incorporating a reflective electrode structure, will be described in detail later (see FIGS. 14, 15).

During the second period Tb2, the display cell P retains the drive voltage, and the liquid crystal display operates totally normally with the scan line drive circuit 2, the signal line drive circuit 3, the source signal generator 4, the common signal generator 5, and other drive-related circuits all deactivated. The deactivation of the drive-related circuits reduces the power consumption by the circuits during the second period Tb2. The reduction in power consumption is especially evident when the signal line drive circuit 3 and associated circuits that include power consuming analog circuits are deactivated.

The drive-related circuits can be actually deactivated by, for example, the controller 6 as deactivation control means suspending the power supply from the power source and the application of control signals to the source signal generator 4 and the common signal generator 5 based on the start and end timings of the second period Tb2 given by the source signal generator 4 or the common signal generator 5. The drive-related circuits can be deactivated in other ways too: for example, the drive IC may be set to operate in power consumption mode. Another example is to use the controller 6 to increase the output impedance of the buffer circuits coupled to the outputs from the scan line drive circuit 2 and signal line drive circuit 3 and hence block current flow.

[Embodiment 2]

The following will describe embodiment 2 in accordance with the present invention in reference to FIGS. 1, 8–11, 17, 18, 21, and 22. Here, for convenience, members of the present embodiment that have the same arrangement and function as members of embodiment 1, and that are mentioned in that embodiment are indicated by the same reference numerals and description thereof is omitted.

Referring to FIG. 1, like the liquid crystal display of embodiment 1, a liquid crystal display of the present embodiment is composed of a liquid crystal panel 1, a scan line drive circuit 2, a signal line drive circuit 3, a source signal generator 4, a common signal generator 5, and a controller 6. The present liquid crystal display differs from the liquid crystal display of embodiment 1 in that in the former the source signal Vs changes polarity with respect to the common signal Vcom in every frame and the common signal Vcom is constant.

The drive operation of the liquid crystal display thus arranged is now described.

Figure 8:
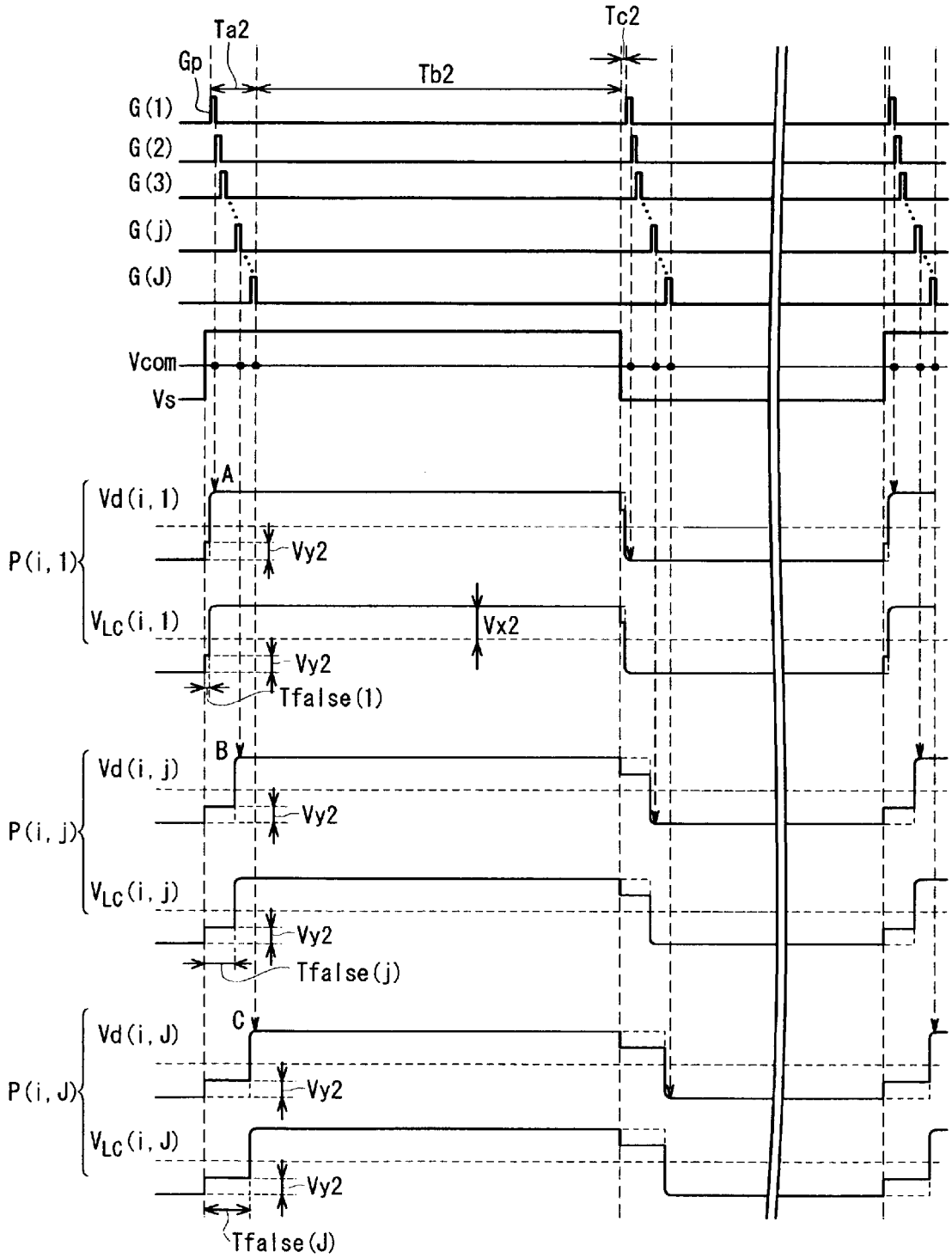
FIG. 8 is a waveform diagram showing a driving operation of embodiment 2 in accordance with the present invention, in which the source signal for a liquid crystal display changes in polarity.

FIG. 8 describes, by means of waveform, development of drive voltage applied to display cells in the liquid crystal panel 1: namely, the display cell P(i,1) located in the i-th column, $1^{st}$ row, the display cell P(i,j) centrally located in the i-th column, j-th row, and the display cell P(i,J) located in the i-th column, J-th row. The figure shows an example in which the common signal Vcom is steady at 2 V and the source signal Vs alternates by a 4 V amplitude to create ±2 V drive voltages for application to the display cell Ps.

Referring to the display cell P(i,1) in the top row, the drain voltage Vd changes in accordance with the source signal Vs concurrently with the polarity change of the source signal Vs at the end of the preceding second period Tb2 (not shown). The voltage retained by the liquid crystal cell P after the source signal Vs has changed is lower than the otherwise retained standard voltage Vx2 by a fall voltage Vy2 as described in embodiment 1 in relation with common signal Vcom. In the succeeding first period Ta2, the source signal (voltage) Vs is written as the TFT 11 is switched on by a gate pulse GP fed through the scan line G(1) at point A, which renders the drain voltage Vd equal to the source voltage. With the TFT 11 switched off later, the voltage across the liquid crystal does not change because of the presence of liquid crystal capacitance $C_{LC}$. The retained voltage level of the drive signal $V_{LC}$(i,1) also falls by a fall voltage Vy2 as does the drain voltage Vd.

With the scan period, i.e., the first period Ta2, coming to an end, the voltage level of the drive signal $V_{LC}$(i,1) is retained during the succeeding second period Tb2, since no scanning is performed during the period. With the source signal Vs changing in polarity at the end of the second period Tb2, the drain voltage Vd changes similarly as described in the foregoing. This way, an image is written and retained in each frame.

Referring to the central display cell P(i,j), the falling period Tfalse(j) extending from the time when the drain voltage Vd changes in level concurrently with the polarity change of the source signal Vs at the end of the preceding second period Tb2 (not shown) to the time when the source (voltage) signal Vs written (at point B) is longer than the falling period Tfalse(1) of the display cell P(i,1). Referring to the display cell P(i,J) in the bottom row, the falling period Tfalse(J) (period extending from the polarity change of the source signal Vs to point C) is longer than the falling period Tfalse(j).

Figure 9:
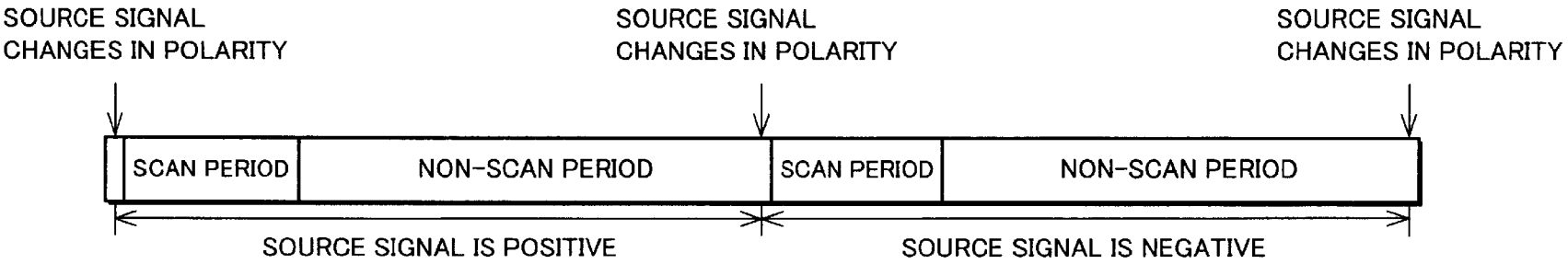
FIG. 9 is an explanatory drawing depicting the concept of a driving operation in which the source signal of the liquid crystal display changes in polarity.
Figure 10:
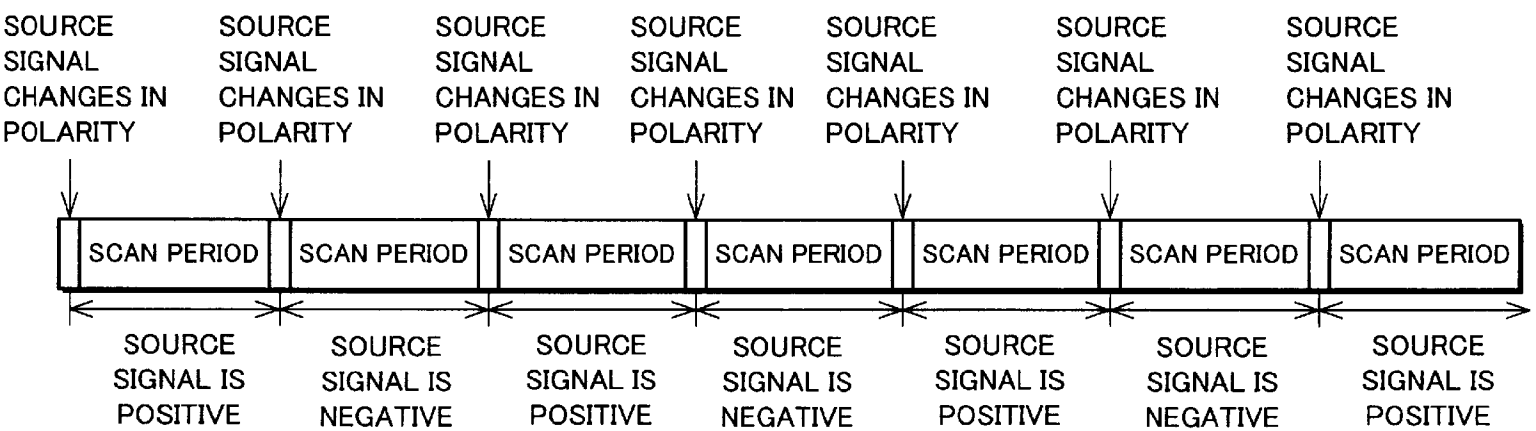
FIG. 10 (PRIOR ART)
FIG. 10 is an explanatory drawing depicting the concept of a driving operation based on a conventional drive scheme for comparison.

Meanwhile, in the refresh period Tpol for writing and retaining for one frame is there provided a non-scan period (second and third periods Tb2, Tc2) following a scan period (first period Ta2) as shown in FIG. 9, and the source signal Vs changes in polarity at the end of the second period Tb2. The voltage retained by the display cell P during the non-scan period ensures brightness. This allows for reduced differences in brightness among the top, middle, and bottom rows as shown in FIG. 10, in comparison with conventional drive schemes with no non-scan periods.

Similarly to the liquid crystal display of embodiment 1, in the present liquid crystal display, satisfactory display quality can be again achieved if the non-scan period is equal to or longer than the scan period. It should be noted however that the display quality is negatively affected by the end of the second period Tb2 during which the source signal Vs changes in polarity, that is, the length of the second period Tb2. At whatever timing the source signal Vs may change in polarity, row-to-row differences in brightness can be reduced so long as the ratio of the non-scan and scan periods satisfy the above relationship. Nevertheless, for example, in the case of a liquid crystal display of normally white mode, the closer the timing of polarity change is moved to the start of the second period Tb2 (i.e., the shorter the second period Tb2), the higher the overall brightness of the display image and the brighter the whole image; the original brightness of the display image is not obtainable. Considering these contributing factors, to produce satisfactory brightness, the source signal Vs should change in polarity in the latter half of the non-scan period which is equivalent to the second and third periods Tb2, Tc2 combined, and the second period Tb2 should be extended backwards so that the timing of the polarity change is as close to (preferably immediately before) the start of the third period Tc2 as possible.

Now, referring to the present liquid crystal display, in the liquid crystal panel 1 with a reflective electrode structure shown in FIG. 21 and FIG. 22, the drive voltage $V_{LC}$(i,1) for the top row remains equal to the standard voltage Vx2 during the first and second period Ta2, Tb2 as shown in FIG. 8 and falls from the standard voltage Vx2 by a fall voltage Vy2, as given by equation (2), in the third period Tc2. The effective value, $V_{LC}$rms(i,1) of the drive voltage $V_{LC}$(i,1) is given by equation (3). The drive signal $V_{LC}$(i,J) for the bottom row remains equal to the standard voltage Vx2 during the second period Tb2 and falls from the standard voltage Vx2 during the first and third periods Ta2, Tc2 by the fall voltage Vy2. The effective value, $V_{LC}$rms(i,J) of the drive signal $V_{LC}$(i,J) is given by equation.

Here, Vx2=2 V, Vac2 (amplitude of the source signal Vs)=4 V, $C_{LC}$=4.7 pF, Csd1+Csd2+Cgd1+Cgd2=0.3 pF, Csd1+Csd2=0.15 pF, CD=5 pF, Ta2=15 mS, Tb2=80 mS, and Tc2=0.5 mS. Substituting these values in equations (3) and (4), we obtain $V_{LC}$rms(i,1)=1.999 Vrms and $V_{LC}$rms(i, J)=1.981 Vrms. The two effective values have a difference of about 0.02 Vrms, which means that the effective value of the drive voltage for the display cell P varies a maximum of 0.02 Vrms, when comparing the top to the bottom of the screen. The difference of voltage is hence sufficiently restrained to produce substantially equal brightness between the top and the bottom of the display screen.

Figure 11:
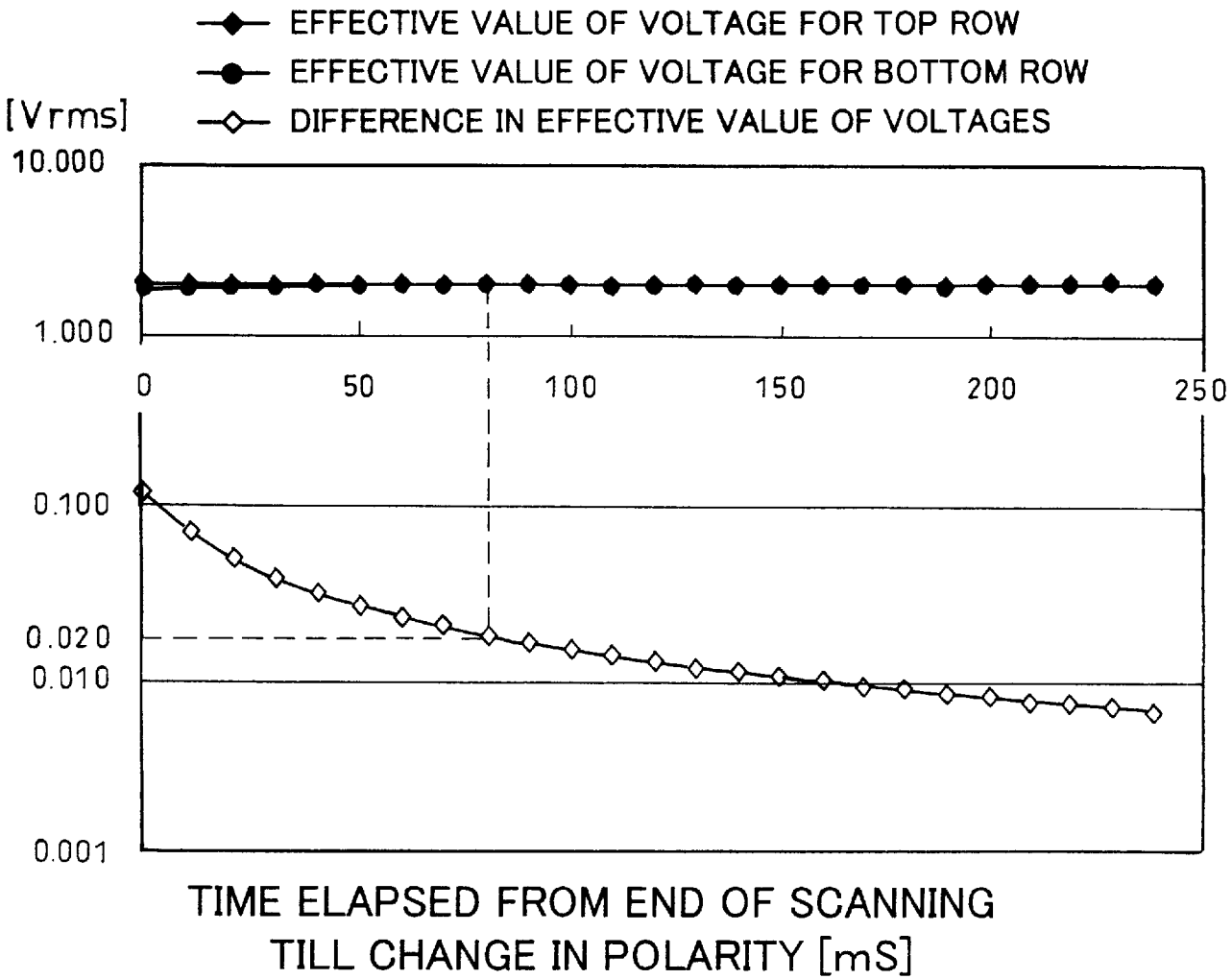
FIG. 11 is a graph showing the relationship between the timings of polarity change of a source signal of the liquid crystal display and an effective value of a drive (voltage) signal for the top and bottom rows of the display screen.

FIG. 11 is a graph showing the relationship between the duration of the second period Tb2 extending from the end of the first period Ta2 to the polarity change of the source signal Vs and the difference in effective value of the voltage level of the drive signal $V_{LC}$ between the top and bottom rows, where Vx2=2 V, Vac=4 V, $C_{LC}$=4.7 pF, Csd1+Csd2+Cgd1+Cgd2=0.3 pF, Csd1+Csd2=0.15 pF, CD=5 pF, Ta2=15 mS, and Tc2=0.5 mS. Effective values of voltages are expressed in logarithm on the vertical axis. From the graph, it is understood that the second period Tb2 is 80 mS when the difference in effective value of the voltage level is 0.02 Vrms.

As described in the foregoing, with the liquid crystal display of the present embodiment, a novel non-scan period (second and third periods Tb2, Tc2) equal to or longer than the scan period is provided immediately following the scan period (first period Ta2), as the case with the liquid crystal display of embodiment 1. This remarkably reduces the difference in effective value of the voltage level applied to the display cell P between the top and bottom rows of the display screen, particularly eliminating differences in brightness between the top and bottom rows. This produces in practice uniform brightness all across the display screen, effectively improving the display quality of the liquid crystal display.

Further, the source signal Vs is specified to change in polarity in the latter half of the non-scan period; reproduction of the original brightness is thereby ensured to a satisfactory degree. Especially, if the polarity change occurs immediately before the end of the non-scan period, reproduction of the original brightness is almost fully ensured. This further improves the display quality of the liquid crystal display.

Similarly to the liquid crystal display of embodiment 1, the present liquid crystal display, when used in a television system or a mobile terminal, is also capable of producing a display with satisfactory quality.

Further, similarly to the liquid crystal display of embodiment 1, the present liquid crystal display can cut down on the power consumption in drive-related circuits by deactivating them during the second period Tb2.

[Embodiment 3]

Figure 12:
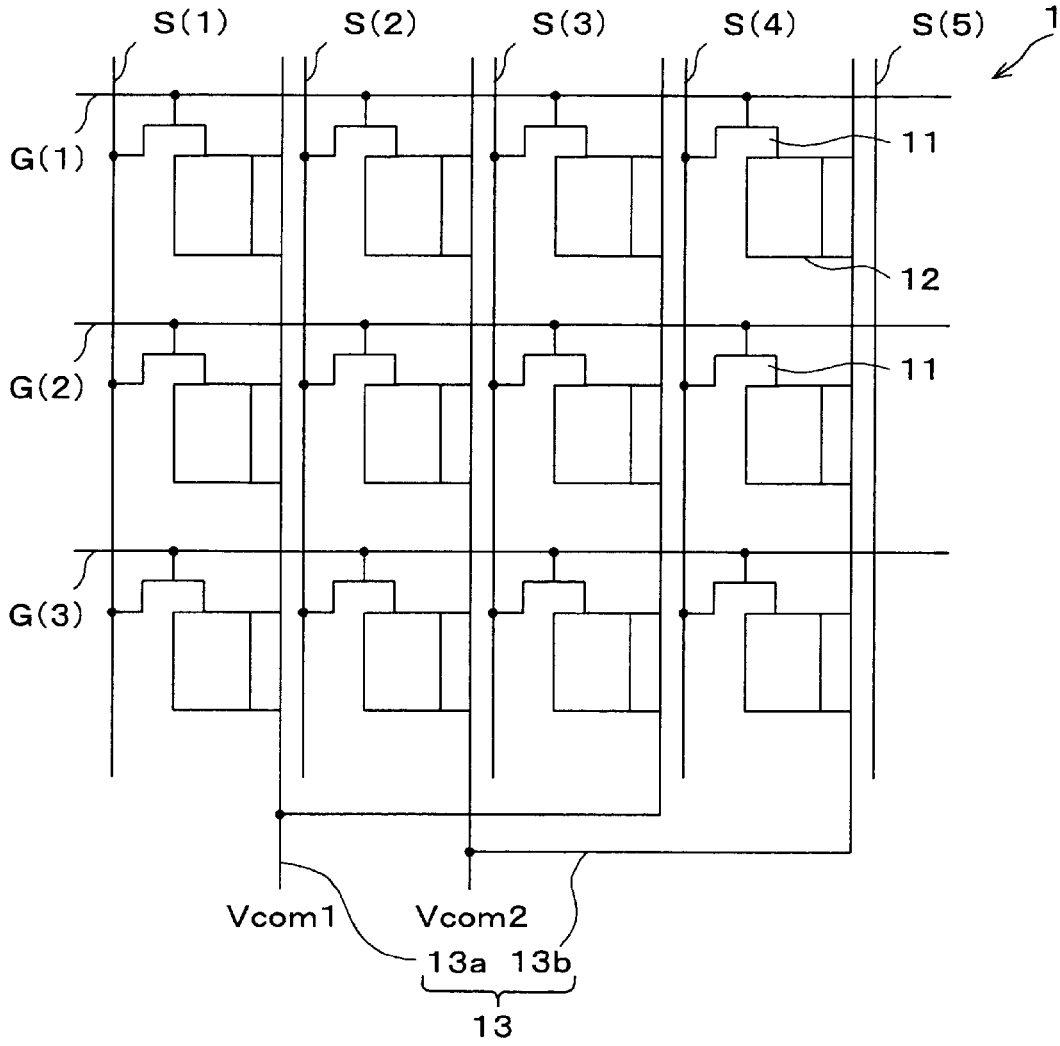
FIG. 12 is a plan view showing an arrangement of electrodes of a liquid crystal panel in a liquid crystal display of embodiment 3 in accordance with the present invention.
Figure 13:
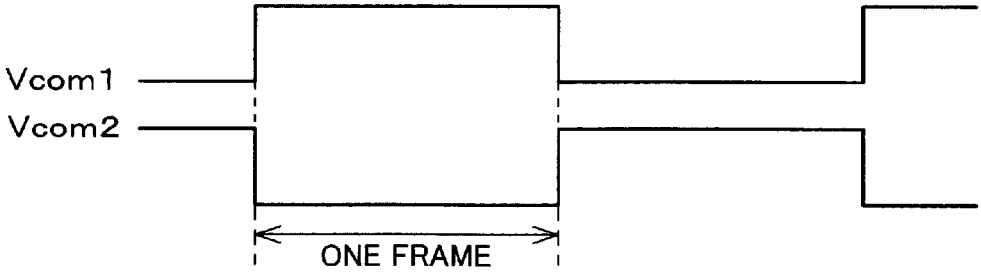
FIG. 13 is a waveform diagram showing two common signals applied to the liquid crystal panel of FIG. 12.

The following will describe embodiment 3 in accordance with the present invention in reference to FIGS. 1, 12, and 13. Here, for convenience, members of the present embodiment that have the same arrangement and function as members of embodiment 1, and that are mentioned in that embodiment are indicated by the same reference numerals and description thereof is omitted.

Referring to FIG. 1, like the liquid crystal display of embodiment 1, a liquid crystal display of the present embodiment is composed of a liquid crystal panel 1, a scan line drive circuit 2, a signal line drive circuit 3, a source signal generator 4, a common signal generator 5, and a controller 6. In the present liquid crystal display, as shown in FIG. 12, an opposite electrode 13 is divided into a first electrode 13*a* and a second electrode 13*b*. The first electrode 13*a* opposes, for example, a display electrode 12 connected to one of two adjacent signal lines S (i), S(i+1). The second electrode 13*b* opposes, for example, a display electrode 12 connected to the other of the two adjacent signal lines S (i), S(i+1). To the first and second electrodes 13*a*, 13*b* are applied respective common signals Vcom1, Vcom2 that are in phase, but of different polarities. See FIG. 13. Therefore, the first electrodes 13*a* and the second electrodes 13*b* are arranged alternately, to which the common signals Vcom1, Vcom2 are applied respectively.

Applying a drive method similar to the one in embodiment 1 to this structure produces advantages, as mentioned earlier, of restraining differences in brightness between the top and bottom rows of the display screen and improving the display quality. Further, with the structure, source line inversion is in practice carried out using a waveform of frame inversion drive; this produces an additional advantage of preventing flickers and other deterioration in display quality.

Reduction in power consumption is again possible in the present embodiment, as is the case in embodiments 1 and 2, by the deactivation of drive-related circuits during the non-scan period.

Throughout the present and foregoing embodiments, description has been so far confined to drive methods of TFT-based active matrix liquid crystal displays and liquid crystal displays employing them; nevertheless, the present invention is further applicable to active liquid crystal displays based on other types of active elements, including those based on MIM (Metal Insulator Metal) elements.

[Structure of Liquid Crystal Display]

Figure 14:
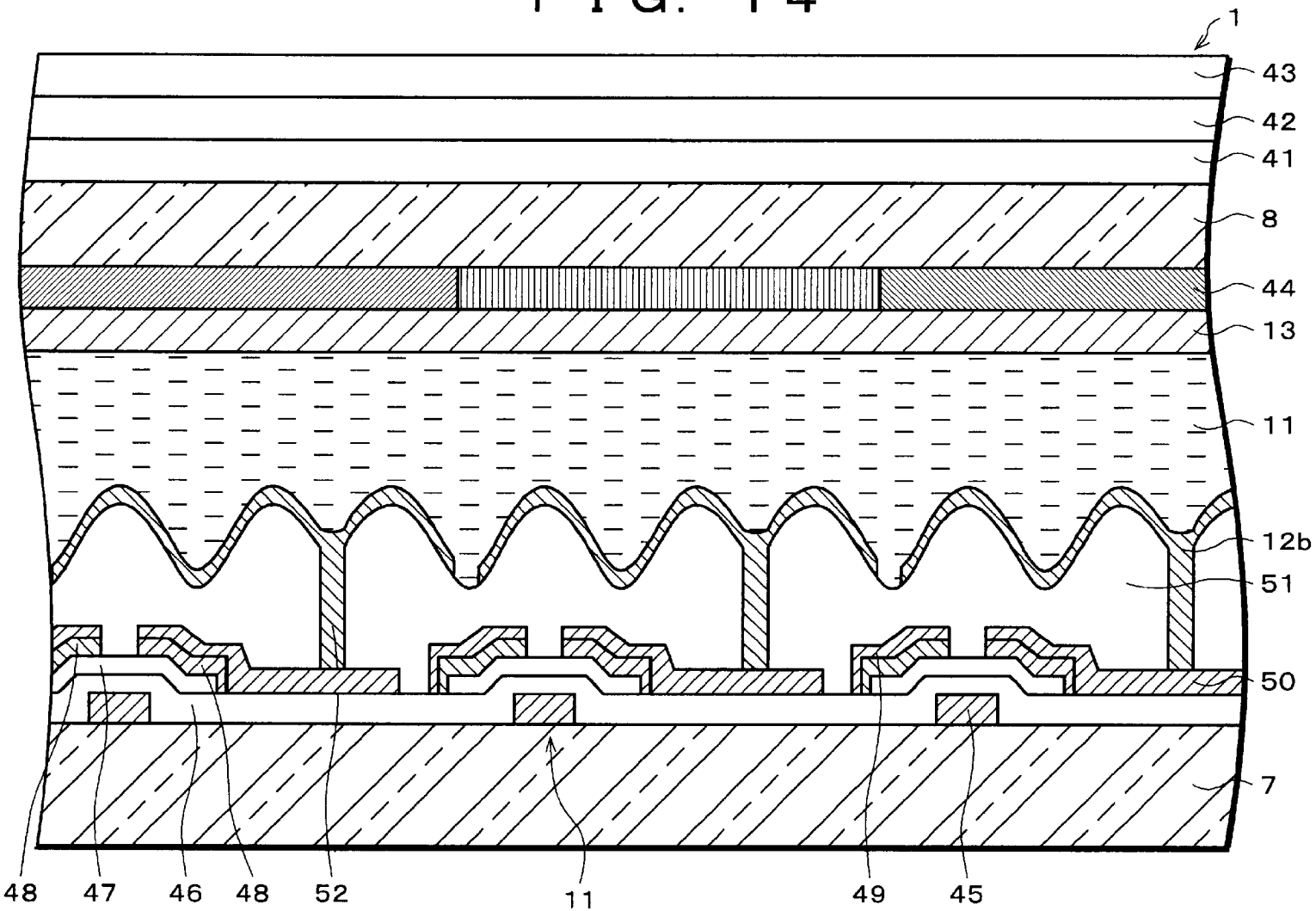
FIG. 14 is a cross-sectional view showing a structure of the liquid crystal displays of embodiments 1–3 in accordance with the present invention.
Figure 15:
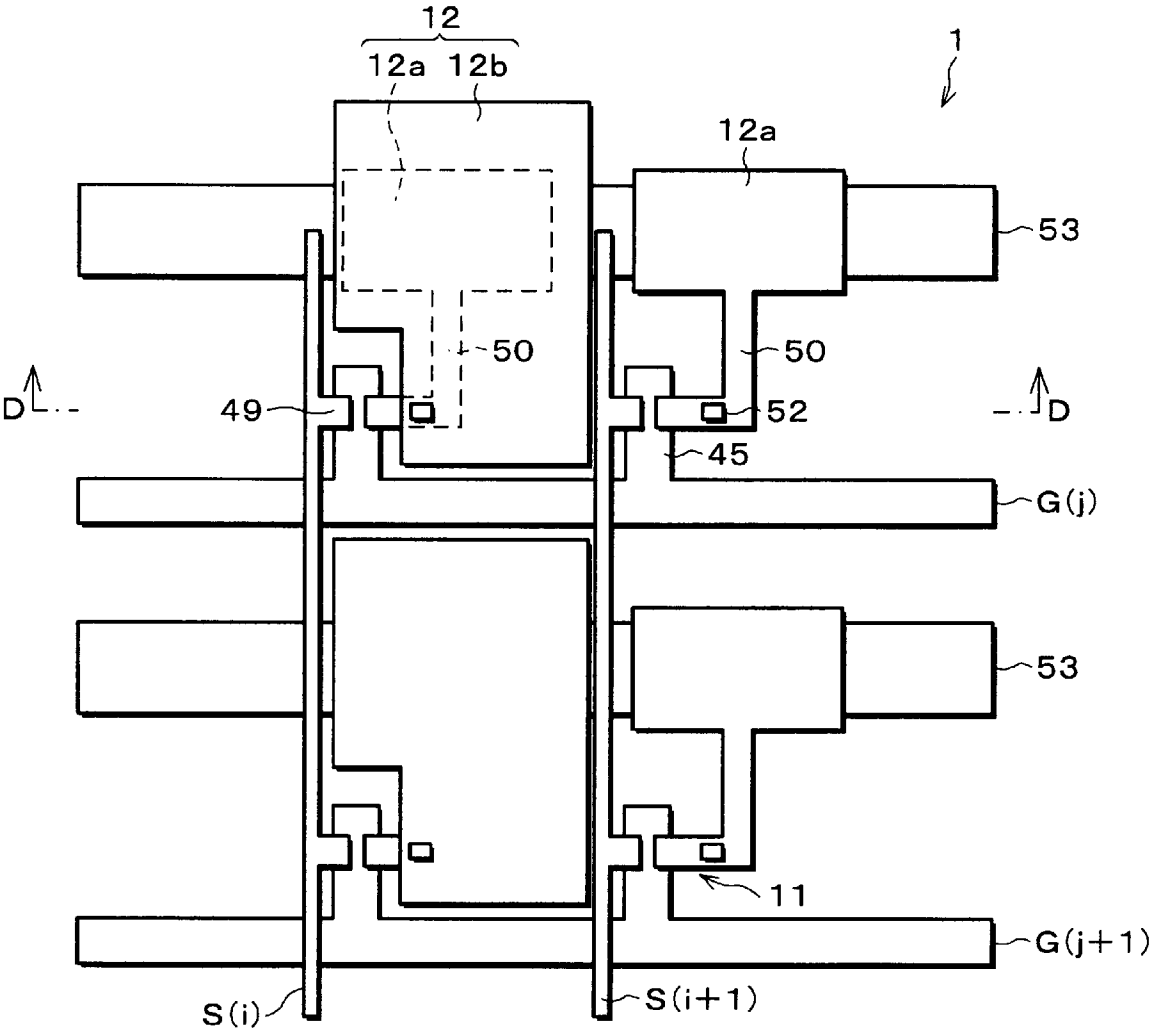
FIG. 15 is a plan view showing a structure of the liquid crystal display of FIG. 14.
Figure 16:
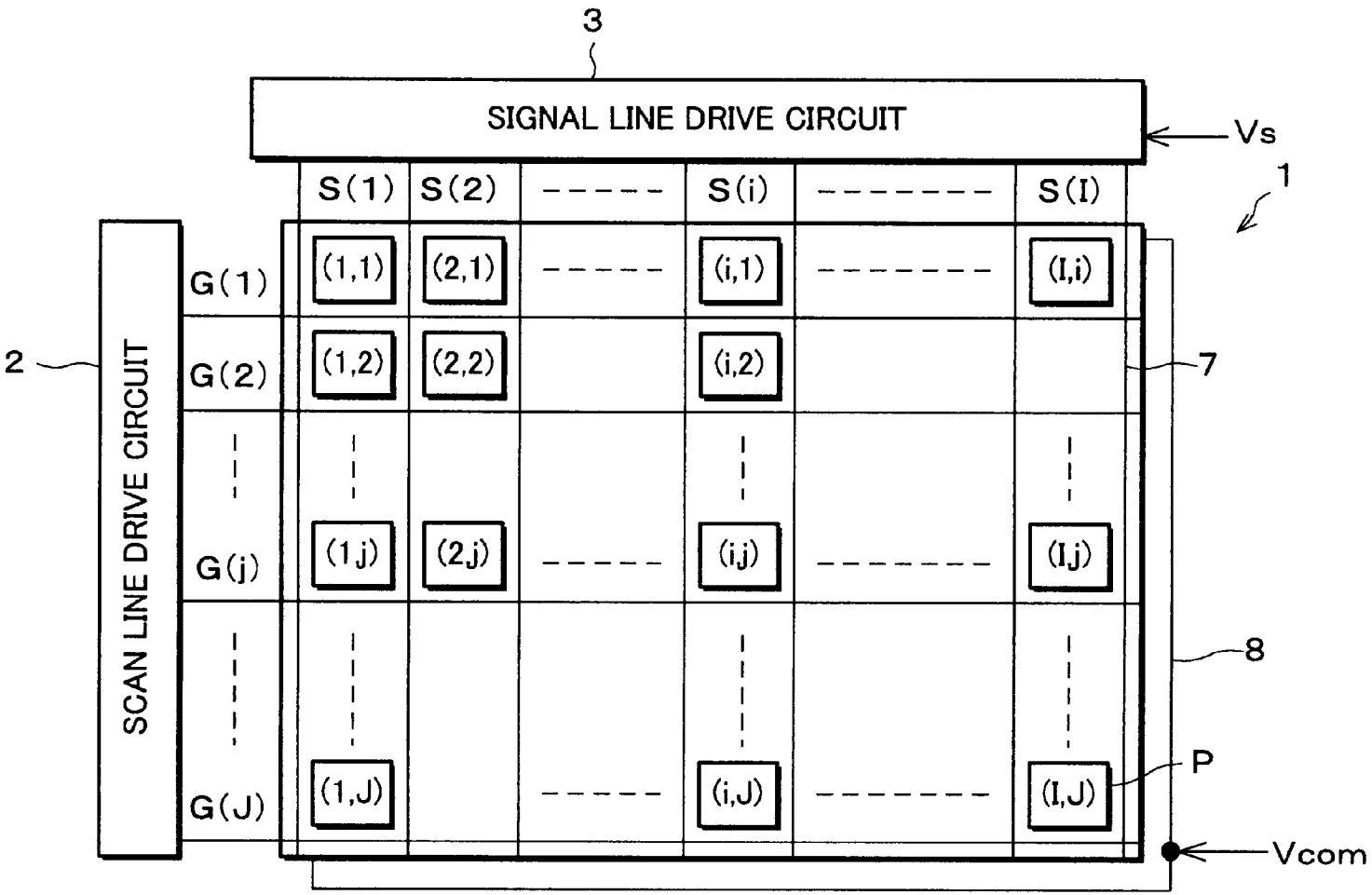
FIG. 16 (PRIOR ART)
FIG. 16 is a block diagram showing an arrangement of a conventional liquid crystal display.

Now, the following will describe a common structure of the liquid crystal displays of the foregoing embodiments in reference to FIG. 14 and FIG. 15.

FIG. 14 shows the structure of the liquid crystal panel 1 in a cross sectional view taken along line D—D in FIG. 15 (detailed later). The liquid crystal panel 1, being a reflective-type active matrix liquid crystal panel, is chiefly composed of a matrix substrate 7 and an opposite substrate 8 sandwiching liquid crystal 14, such as nematic liquid crystal, therebetween, and TFTs 11 as active elements provided on the matrix substrate 7. In the present embodiment, the TFT is used as the active element; other active elements, such as the MIM (Metal Insulator Metal), can be used instead. On the top of the opposite substrate 8, a wave plate 41, a polarizer 42, and a reflection suppression film 43 are provided in this order to control the conditions of incident light. On the bottom of the opposite substrate 8, RGB color filters 44 and transparent opposite electrode 13 are provided in this order. The provision of the color filters 44 enables a color display.

In each TFT 11, a part of the scan line disposed on the matrix substrate 7 serves as a gate electrode 45. A gate insulating film 46 is formed on the gate electrode 45. An i-type amorphous silicon layer 47 is disposed opposite to the gate electrode 45 across the gate insulating film. A $n^+$-type amorphous silicon layer 48 is disposed in two segments to flank the channel area of the i-type amorphous silicon layer 47. A data electrode 49 which constitutes a part of a signal line is formed on the top of one of the segments of the $N^+$-type amorphous silicon layer 48, whereas a drain electrode 50 is formed on the top of the other segment of the $N^+$-type amorphous silicon layer 48 and extends over the top of the flat part of the gate insulating film 46. The terminating end of the elongated drain electrode 50 is connected to a rectangular electrode pad 12*a,* for use with an auxiliary capacitance, which opposes an auxiliary capacitance wire 53 as shown in FIG. 15. On the top of the TFTs 11 is disposed an interlayer insulating film 51 on which reflective electrodes 12*b.* The reflective electrodes 12*b* are reflective members to reflect ambient light to produce a display. The interlayer insulating film 51 has microscopic bumps and dents to control the direction of light reflected by the reflective electrodes 12*b.*

Each reflective electrode 12*b* is electrically connected to the drain electrode 50 in a contact hole 52 formed through the interlayer insulating film 51. So, a voltage is transmitted through the data electrode 49 for control by the TFT 11 and after that applied to the drain electrode 50, the contact hole 52, and then the display electrode 12 where the liquid crystal 14 is driven by the voltage across the reflective electrode 12*b* and the opposite electrode 13. In other words, the electrode pad 12*a* for use with auxiliary capacitance is electrically interconnected to the reflective electrode 12*b,* and the liquid crystal 14 intervenes between the reflective electrode 12*b* and the opposite electrode 13. The electrode pad 12*a* for use with auxiliary capacitance and the reflective electrode 12*b* forms a display electrode 12. In a transmissive-type liquid crystal display, transparent electrodes arranged correspondingly to the respective electrodes serve as the display electrodes 12.

As shown in FIG. 15 which depicts a lower part of the liquid crystal 14 of FIG. 14 as viewed from the above, the liquid crystal panel 1 further includes scan lines G(j) for supplying scan signals to the gate electrodes 45 in the TFTs 11 and signal lines S(i) for supplying data signals to the data electrodes 49 in the TFTs 11 so that the scan and signals lines G(j), S(i) cross at right angles on the matrix substrate 7. The auxiliary capacitance wire 53 is disposed between the electrode pads 12*a* for use with auxiliary capacitance and serves as an auxiliary capacitance electrode forming an auxiliary capacitance in a pixel. The auxiliary capacitance wire 53 is disposed parallel to the scan line G(j) on the matrix substrate 7 so that a part of the auxiliary capacitance wire 53 opposes the electrode pad 12*a* across the gate insulating film 46 at a place other than on the scan line G(j). It is sufficient not only in this case, but generally, if the auxiliary capacitance wire 53 is not disposed at the same position as the scan line G(j). In the figure, some reflective electrodes 12*b* are omitted to illustrate how the electrode pad 12*a* for use with the auxiliary capacitance are positioned relatively to the auxiliary capacitance wire 53. The bumps and dents on the surface of the interlayer insulating film 51 are described in FIG. 14, but omitted in FIG. 15.

As detailed in embodiments 1–3 above, in the active matrix liquid crystal display and the method of driving the same in accordance with the present invention, the inversion control means may change the polarity of the common voltage or signal voltage during the latter half of a non-scan period. This ensures faithful reproduction of the original brightness on a display screen.

In the active matrix liquid crystal display and the method of driving the same in accordance with the present invention, each common electrode may be divided into two or more sub-electrodes, alternate ones of which are fed with a first common voltage and the remaining ones are fed with a second common voltage that is in phase with, but of opposite polarities from, the first common voltage. This enables improvement of display quality with this electrode structure which is suitable for frame inversion drive.

In the active matrix liquid crystal display and the method of driving the same in accordance with the present invention, the active matrix liquid crystal display may be of a reflective type in which some of the display electrodes are reflective electrodes. Many of such liquid crystal displays employ a structure in which overlapping occurs of the display electrodes, scan lines, etc. and has parasitic capacitance between the overlapping display electrodes, scan lines, etc. The use of driving method in accordance with the present invention therefore restrains effects of the parasitic capacitance and improves, as mentioned earlier, display quality.

In the active matrix liquid crystal display and the method of driving the same in accordance with the present invention, the deactivation control means deactivates drive-related circuits during the non-scan period. During the non-scan period, those circuits used for driving do not need to operate, because the display cell retains the drive voltage. The deactivation of the circuits leads to reduction in power consumption.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A method of driving an active matrix liquid crystal display, said active matrix display including a plurality of display cells that are arrayed in scan lines between a top row and a bottom row, in which:

active elements provided for respective, matrix-forming display cells scan the display cells in response to a scan signal a scan line at a time for selection; a signal voltage is written to display electrodes in selected ones of the display cells;

a drive voltage determined by the signal voltage and a common voltage is applied across liquid crystal by applying the common voltage to an opposite electrode positioned opposite to the display electrodes; and the common voltage changes in polarity with respect to the signal voltage in each frame, wherein:

a non-scan period during which the signal voltage is retained and no new signal voltage is written is provided immediately following a scan period in which the signal voltage is written to some of the display cells corresponding to one screen, said scan period being measured from a leading edge of the scan signal output to the matrix-forming display cells arrayed in the top row sequentially to a trailing edge of the scan signal output to the matrix-forming display cells arrayed in the bottom row and said non-scan period being measured from the trailing edge of the scan signal output to the matrix-forming display cells arrayed in the bottom row to a leading edge of a subsequent scan signal output to the matrix-forming display cells arrayed in the top row, the non-scan period being equal to or longer than the scan period; and the common voltage changes in polarity with respect to the signal voltage in the non-scan period.

2. The method of driving an active matrix liquid crystal display as set forth in claim 1, wherein the common voltage changes in polarity in a latter half of the non-scan period.

3. The method of driving an active matrix liquid crystal display as set forth in claim 1, wherein each common electrode is divided into sub-electrodes, alternate ones of which are fed with a first common voltage and the remaining ones are fed with a second common voltage that is in phase with, but of an opposite polarity to, the first common voltage.

4. The method of driving an active matrix liquid crystal display as set forth in claim 1, wherein the active matrix liquid crystal display is of a reflective type in which some of the display electrodes are reflective electrodes.

5. The method of driving an active matrix liquid crystal display as set forth in claim 1, wherein drive-related circuits are deactivated in the non-scan period.

6. A method of driving an active matrix liquid crystal display, said active matrix display including a plurality of display cells that are arrayed in scan lines between a top row and a bottom row, in which:

active elements provided for respective, matrix-forming display cells scan the display cells in response to a scan signal a scan line at a time for selection;

a signal voltage is written to display electrodes in selected ones of the display cells;

a drive voltage determined by the signal voltage and a common voltage is applied across liquid crystal by applying the common voltage to an opposite electrode positioned opposite to the display electrodes; and the signal voltage changes in polarity with respect to the common voltage in each frame, wherein:

a non-scan period during which the signal voltage is retained and no new signal voltage is written is provided immediately following a scan period in which the signal voltage is written to some of the display cells corresponding to one screen, said scan period being measured from a leading edge of the scan signal output to the matrix-forming display cells arrayed in the top row sequentially to a trailing edge of the scan signal output to the matrix-forming display cells arrayed in the bottom row and said non-scan period being measured from the trailing edge of the scan signal output to the matrix-forming display cells arrayed in the bottom row to a leading edge of a subsequent scan signal output to the matrix-forming display cells arrayed in the top row, the non-scan period being equal to or longer than the scan period; and the signal voltage changes in polarity with respect to the common voltage in the non-scan period.

7. The method of driving an active matrix liquid crystal display as set forth in claim 6, wherein the signal voltage changes in polarity in a latter half of the non-scan period.

8. The method of driving an active matrix liquid crystal display as set forth in claim 6, wherein each common electrode is divided into sub-electrodes, alternate ones of which are fed with a first common voltage and the remaining ones are fed with a second common voltage that is in phase with, but of an opposite polarity to, the first common voltage.

9. The method of driving an active matrix liquid crystal display as set forth in claim 6, wherein the active matrix liquid crystal display is of a reflective type in which some of the display electrodes are reflective electrodes.

10. The method of driving an active matrix liquid crystal display as set forth in claim 6, wherein drive-related circuits are deactivated during the non-scan period.

11. An active matrix liquid crystal display, said active matrix display includes a plurality of display cells that are arrayed in scan lines between a top row and a bottom row, in which:

active elements provided for respective, matrix-forming display cells scan the display cells in response to a scan signal a scan line at a time for selection;

a signal voltage is written to display electrodes in selected ones of the display cells;

a drive voltage determined by the signal voltage and a common voltage is applied across liquid crystal by applying the common voltage to an opposite electrode positioned opposite to the display electrodes; and the common voltage changes in polarity with respect to the signal voltage in each frame, the active matrix liquid crystal display comprising:

non-scanning means for providing a non-scan period during which the signal voltage is retained and no new signal voltage is written, immediately following a scan period in which the signal voltage is written to some of the display cells corresponding to one screen, said scan period being measured from a leading edge of the scan signal output to the matrix-forming display cells arrayed in the top row sequentially to a trailing edge of the scan signal output to the matrix-forming display cells arrayed in the bottom row and said non-scan period being measured from the trailing edge of the scan signal output to the matrix-forming display cells arrayed in the bottom row to a leading edge of a subsequent scan signal output to the matrix-forming display cells arrayed in the top row, the non-scan period being equal to or longer than the scan period; and inversion control means for changing the common voltage in polarity with respect to the signal voltage in the non-scan period.

12. The active matrix liquid crystal display as set forth in claim 11, wherein the inversion control means changes the common voltage in polarity in a latter half of the non-scan period.

13. The active matrix liquid crystal display as set forth in claim 11, further comprising:

common electrodes each divided into sub-electrodes; and voltage application means for applying a first common voltage to alternate ones of the sub-electrodes and a second common voltage to the remaining ones, the first and second common voltages being in phase, but of different polarities.

14. The active matrix liquid crystal display as set forth in claim 11, wherein the active matrix liquid crystal display is of a reflective type in which some of the display electrodes are reflective electrodes.

15. The active matrix liquid crystal display as set forth in claim 11, further comprising deactivation control means for deactivating drive-related circuits during the non-scan period.

16. An active matrix liquid crystal display, said active matrix display includes a plurality of display cells that are arrayed in scan lines between a top row and a bottom row, in which:

active elements provided for respective, matrix-forming display cells scan the display cells in response to a scan signal a scan line at a time for selection;

a signal voltage is written to display electrodes in selected ones of the display cells;

a drive voltage determined by the signal voltage and a common voltage is applied across liquid crystal by applying the common voltage to an opposite electrode positioned opposite to the display electrodes; and the signal voltage changes in polarity with respect to the common voltage in each frame, the active matrix liquid crystal display comprising:

non-scanning means for providing a non-scan period during which the signal voltage is retained and no new signal voltage is written, immediately following a scan period in which the signal voltage is written to some of the display cells corresponding to one screen, said scan period being measured from a leading edge of the scan signal output to the matrix-forming display cells arrayed in the top row sequentially to a trailing edge of the scan signal output to the matrix-forming display cells arrayed in the bottom row and said non-scan period being measured from the trailing edge of the scan signal output to the matrix-forming display cells arrayed in the bottom row to a leading edge of a subsequent scan signal output to the matrix-forming display cells arrayed in the top row, the non-scan period being equal to or longer than the scan period; and inversion control means for changing the signal voltage in polarity with respect to the common voltage in the non-scan period.

17. The active matrix liquid crystal display as set forth in claim 16, wherein the inversion control means changes the signal voltage in polarity in a latter half of the non-scan period.

18. The active matrix liquid crystal display as set forth in claim 16, further comprising:

common electrodes each divided into sub-electrodes; and voltage application means for applying a first common voltage to alternate ones of the sub-electrodes and a second common voltage to the remaining ones, the first and second common voltages being in phase, but of different polarities.

19. The active matrix liquid crystal display as set forth in claim 16, wherein the active matrix liquid crystal display is of a reflective type in which some of the display electrodes are reflective electrodes.

20. The active matrix liquid crystal display as set forth in claim 16, further comprising deactivation control means for deactivating drive-related circuits during the non-scan period.

* * * * *